US007032310B1

(12) United States Patent
Appleford et al.

(10) Patent No.: US 7,032,310 B1
(45) Date of Patent: Apr. 25, 2006

(54) METHOD OF INSTALLING A SOCKET WITH A SOCKET CONTACT ON AN UNDERWATER PLUG WITH A PLUG CONTACT

(75) Inventors: David Eric Appleford, Epping (GB); Brian William Lane, Canvey Island (GB); Benjamin McGeever, Cheltenham (GB)

(73) Assignee: Alpha Thames Ltd., Essex (GB)

( * ) Notice: Subject to any disclaimer, the term of this patent is extended or adjusted under 35 U.S.C. 154(b) by 546 days.

(21) Appl. No.: 10/048,374

(22) PCT Filed: Jul. 28, 2000

(86) PCT No.: PCT/GB00/02916

§ 371 (c)(1),
(2), (4) Date: Apr. 17, 2002

(87) PCT Pub. No.: WO01/09982

PCT Pub. Date: Feb. 8, 2001

(30) Foreign Application Priority Data

Jul. 30, 1999 (GB) ..... 9918062

(51) Int. Cl.
*H01R 43/00* (2006.01)

(52) U.S. Cl. ..... 29/870; 29/876; 29/869; 29/884; 439/204

(58) Field of Classification Search ..... 29/876, 29/883, 884, 623.2, 454, 802, 868–870; 439/199–201; 174/21 R; 166/341, 65.1
See application file for complete search history.

(56) References Cited

U.S. PATENT DOCUMENTS

| | | | | |
|---|---|---|---|---|
| 3,324,449 | A | 6/1967 | McLoad | |
| 4,050,765 | A * | 9/1977 | Duesterhoeft et al. | 439/205 |
| 4,192,569 | A * | 3/1980 | Mucci | 439/204 |
| 4,363,168 | A * | 12/1982 | Bryer et al. | 29/869 |
| 4,859,196 | A | 8/1989 | Durando et al. | |
| 5,254,011 | A | 10/1993 | Ishikura et al. | |
| 6,446,682 | B1 * | 9/2002 | Viken | 141/59 |

FOREIGN PATENT DOCUMENTS

| | | |
|---|---|---|
| WO | WO 89/08934 | 9/1989 |

* cited by examiner

*Primary Examiner*—Minh Trinh
(74) *Attorney, Agent, or Firm*—Summa, Allan & Additon, P.A.

(57) ABSTRACT

A method of installing a socket with a socket contact on an underwater plug with a plug contact is provided so as to establish conductive contact between the socket contact and the plug contact. The socket is disconnectably attached to a recoverable fluid exchange unit and the socket engages with the plug to establish the conductive contact between the socket contact and plug contact. The recoverable fluid exchange unit is then operated to substantially replace a first fluid within the socket with a second fluid from the recoverable fluid exchange unit.

19 Claims, 23 Drawing Sheets

METHOD OF INSTALLING A SOCKET WITH A SOCKET CONTACT ON AN UNDERWATER PLUG WITH A PLUG CONTACT

BACKGROUND OF THE INVENTION

This invention relates to electrical connectors and particularly to electrical connectors for use underwater.

A known electrical connector for making underwater connections is described in patent WO89/08934. The connector includes a plug with an electrical contact pin and a socket adapted to receive the contact pin and which contains a socket contact for electrical engagement with the contact pin of the plug. The socket forms part of a socket module which includes a chamber filled with gas at a lower pressure than that of liquid in the socket. When the plug engages the socket valve means permit substantially all of the liquid in the socket to be exchanged for gas from the chamber. The chamber and valve means remain connected to the engaged plug and socket and are accordingly not available for use in establishing a further electrical connection. Furthermore, should any maintenance of the valve means, chamber or any other part of the complex and expensive equipment associated with the socket become necessary, disconnection of the socket from the plug will be necessary in order that such equipment can be returned to the surface for the necessary maintenance.

An object of the invention is to overcome at least some of the disadvantages associated with such prior art electrical connectors.

SUMMARY OF THE INVENTION

Thus according to a first aspect of the present invention there is provided a method of installing a socket with a socket contact on an underwater plug with a plug contact so as to establish conductive contact between the socket contact and the plug contact, characterized by the steps of:

(a) providing a recoverable fluid exchange unit;

(b) engaging the socket with the plug and establishing the conductive contact between the socket and plug contacts;

(c) operating the fluid exchange unit to substantially replace a first fluid within the socket with a second fluid from the fluid exchange unit, wherein the recoverable fluid exchange unit is connected to the socket before or after step (b); and (d) disconnecting the fluid exchange unit from the socket and recovering it.

It may be desirable for the step of substantially replacing the first fluid within the socket to include discharging the first fluid exteriorly of the fluid exchange unit and the socket.

The method may include the step of supplying a flushing fluid to the plug after the first fluid within the socket has been substantially removed therefrom. This allows the socket to be flushed clean whilst underwater. The flushing fluid may be forced from a chamber of the fluid exchange unit into the socket by ambient pressure. The ambient pressure may act on at least a flexible portion of a wall of the flushing fluid chamber. It may be desirable to include the step of substantially replacing the removed first fluid with the second fluid before supplying the flushing fluid to the plug. The flushing fluid may be substantially removed from the socket and subsequently charging the socket with the second fluid. The second fluid may be accommodated in a pressure vessel in the fluid exchange unit. It may be delivered to the socket as a consequence of the first fluid being drawn out of the socket.

At least one of the flows of fluid to or from the socket may be effected by at least one positive displacement device of the fluid exchange unit. The or each positive displacement device may comprise a positive displacement pump. There could be simultaneous exchange of fluids between the socket and a fluid storage region of the fluid exchange unit wherein one positive displacement device may be used to force one fluid into the socket and simultaneously draw a second fluid therefrom. At least one of the positive displacement devices could be connected by ducts and valve means so that movement of a displaceable member thereof acts to force a second fluid from one part of the device to the socket and simultaneously draw a first fluid from the socket into a second part thereof. The or each positive displacement device may comprise a piston and cylinder device activated by an actuator. Each actuator could comprise a pump which is selectively connectable to pressurized actuator fluid on a first or second side of an actuator piston slidable in an actuator cylinder. Alternatively, the or each actuator may comprise mechanical and/or electrical means.

The step of substantially replacing the first fluid within the socket could include transferring the first fluid from the socket to a fluid storage region of the fluid exchange unit. Thus, if the first fluid is considered harmful to the environment surrounding the fluid exchange unit and socket it would not need to be discharged into it.

The step of engaging the socket with the plug may include venting the socket exteriorly of the fluid exchange unit to permit part of the first fluid in the socket displaced by entry of the plug thereinto to be discharged exteriorly of the fluid exchange unit. Alternatively, the socket may be connected to a compensator of the fluid exchange unit into which a part of the first fluid displaced by entry of the plug thereinto flows thus preventing the first fluid being discharged into the environment surrounding the fluid exchange unit and socket.

The step of replacing the first fluid in the socket with the second fluid from the fluid exchange unit could include the steps of exchanging the first fluid in the socket with a flushing fluid into the fluid exchange unit; and subsequently exchanging the flushing fluid in the socket with the second fluid from the fluid exchange unit. This allows the socket to be flushed clean whilst underwater. It may be convenient for the step of substantially replacing the first fluid within the socket with the second fluid from the fluid exchange unit to cause the socket to be pressure sealed from the environment surrounding the socket.

The flow of fluids between the socket and the fluid exchange unit may be controlled by valve means of the fluid exchange unit. The valve means could comprise a plurality of spool valves.

The step of disconnecting the fluid exchange unit from the socket may include disconnecting one or more stab connectors between the fluid exchange unit and the socket each of which has male and female parts which are disengageable by pulling the fluid exchange unit away from the socket. The or each stab connector may comprise at least part of a separable fluid connection interconnecting the fluid exchange unit and the socket. There are preferably two separable fluid connections. The socket portions of the two connections are preferably in fluid communication with an interior chamber of the socket substantially at opposite ends thereof.

According to a second aspect of the present invention there is provided a method of retrieving a socket from an underwater plug comprising a reversal of the steps set out in the method described above. The retrieved socket may be reused for connection to another plug. The fluid exchange unit may be reused to replace a first fluid in another socket with a second fluid from the fluid exchange unit.

According to a third aspect of the invention there is provided an apparatus including a fluid exchange unit for effecting installation of a socket with a socket contact on an underwater plug with a plug contact so as to establish conductive contact between the socket contact and the plug contact, characterized in that the fluid exchange unit is adapted to be connected to the socket and is recoverable, the fluid exchange unit comprising means to substantially replace a first fluid within the socket with a second fluid from the fluid exchange unit, the fluid exchange unit being connected to the socket before or after the installation of the socket on the plug, and the apparatus comprising means for disconnecting the fluid exchange unit from the socket.

The fluid exchange unit could include a reservoir of flushing fluid and means for flowing the flushing fluid into the socket.

The socket may include means for spraying the flushing fluid inside the socket, said spraying means being adapted to spray the flushing fluid over a plug installed in the socket.

Mechanical securing means for securing the socket to the fluid exchange unit may be included. Means may be included for remotely selectively engaging and disengaging the mechanical securing means.

The fluid exchange unit may include means for remotely actuating valve means for controlling fluid flow to and/or from the socket.

The apparatus of the present invention advantageously makes use of non-specialized components.

BRIEF DESCRIPTION OF THE DRAWINGS

Four embodiments of the present invention will now be described by way of example with reference to the accompanying figures, in which:—

The embodiments are the same except where noted.

DETAILED DESCRIPTION OF THE PREFERRED EMBODIMENT

Figure 1:
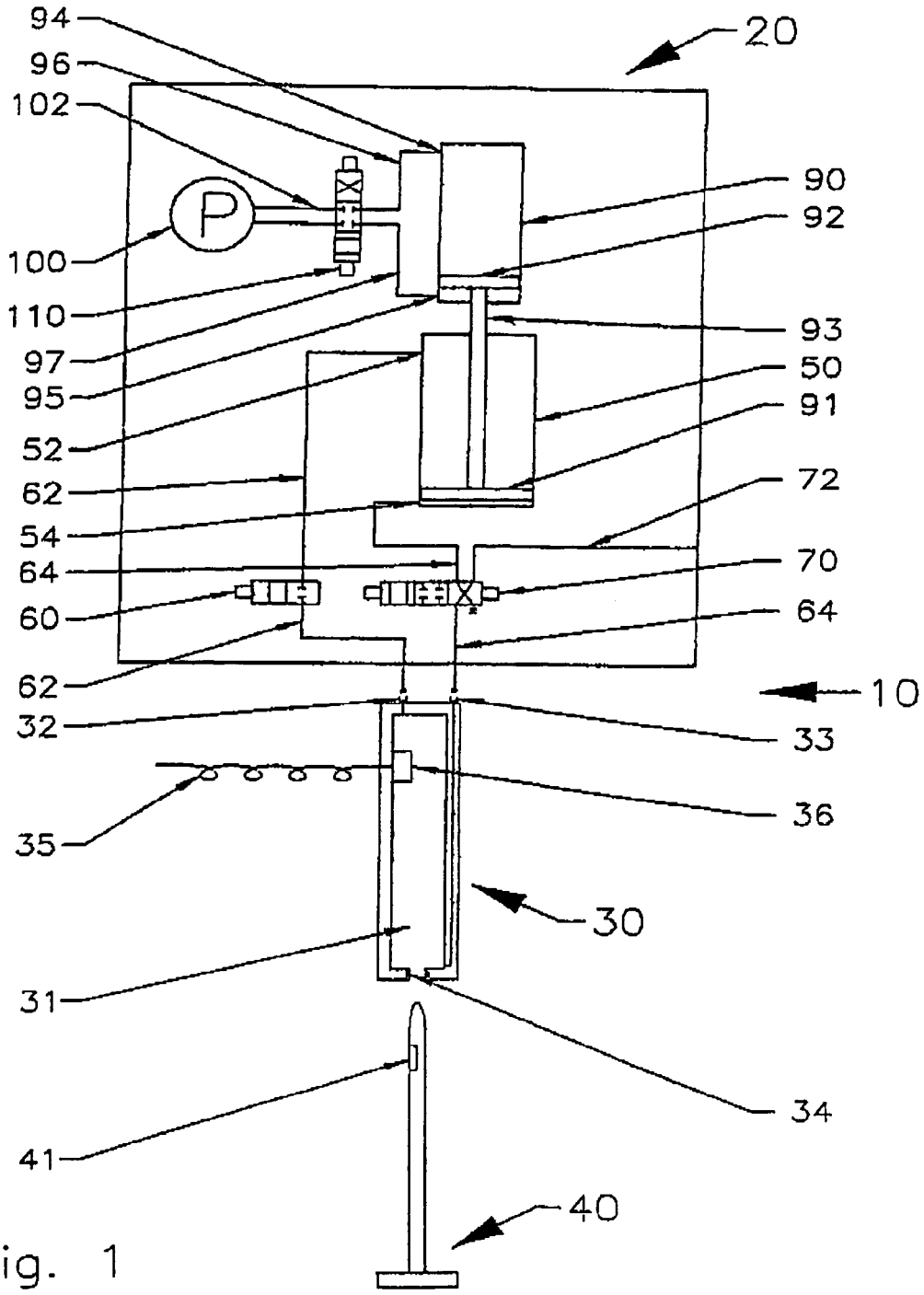
FIG. 1 is a detailed schematic view of an electrical connector and plug of a first embodiment of the invention.
Figure 2C:
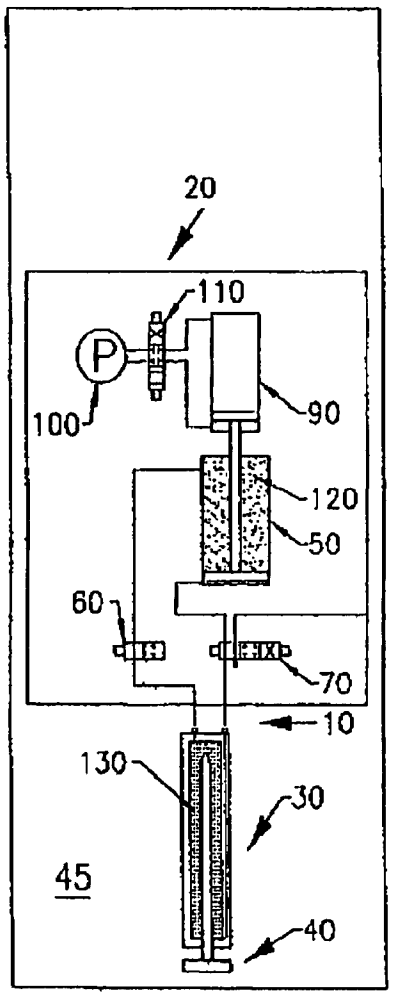
FIGS. 2(*a*) to 2(*f*) are schematic views of the first embodiment of the invention showing the installation of the socket of the connector on the plug.
Figure 2B:
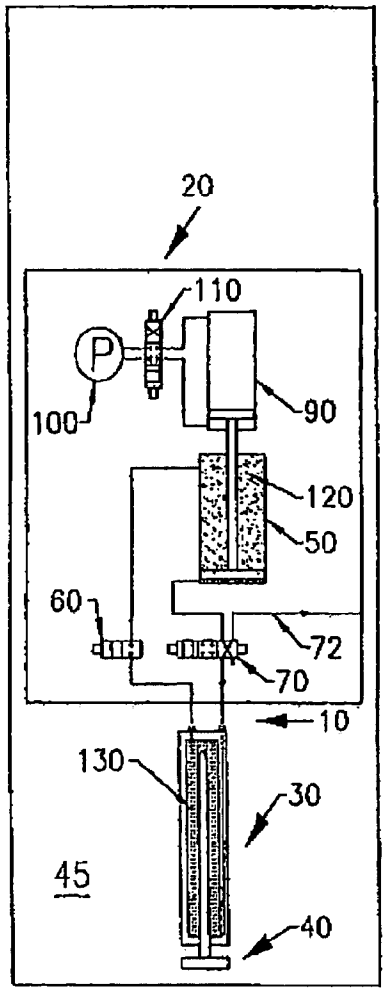
Figure 2A:
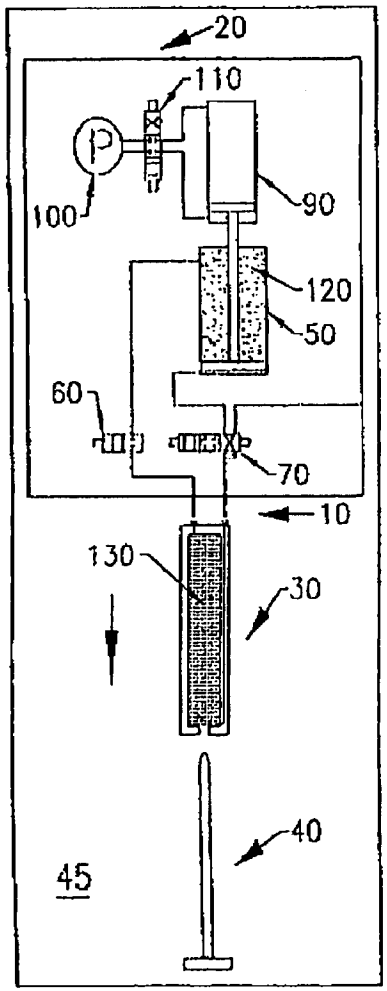
Figure 2F:
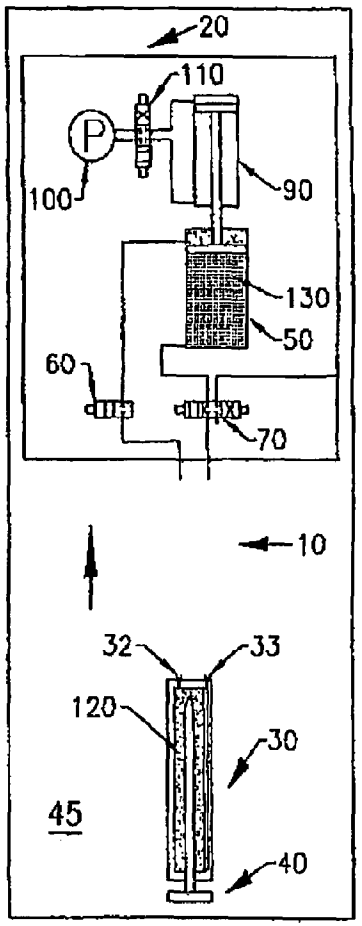
Figure 2E:
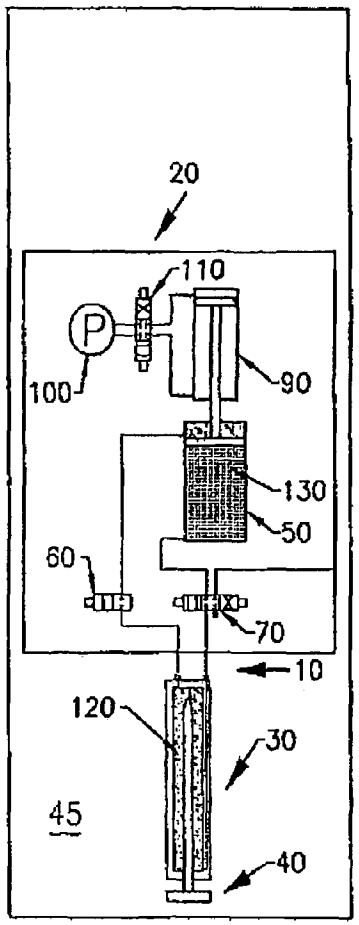
Figure 2D:
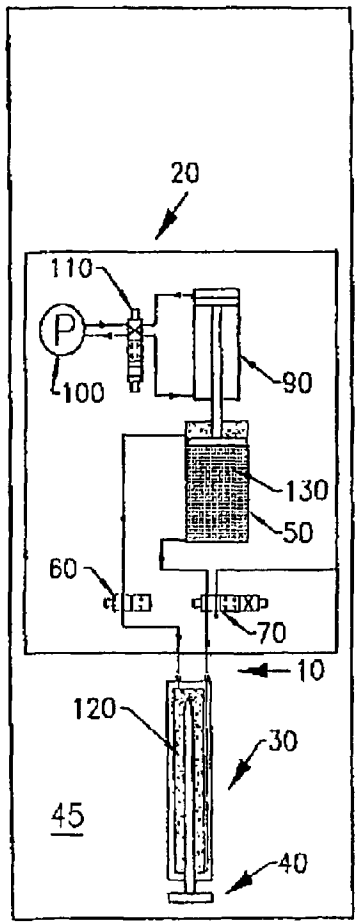
Figure 3C:
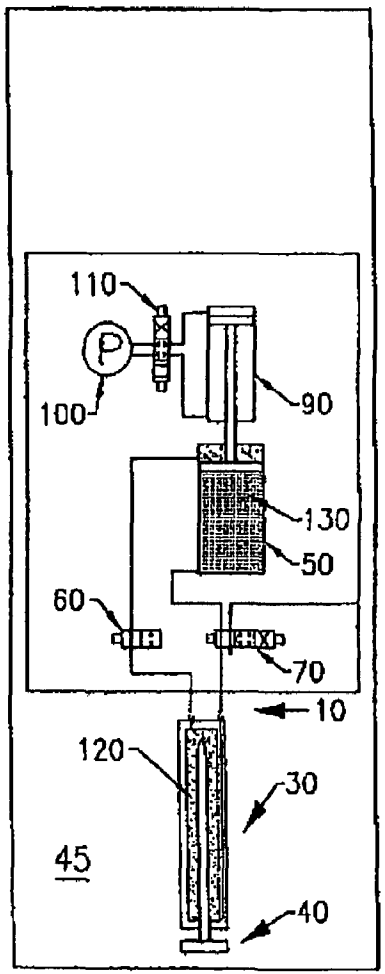
FIGS. 3(*a*) to 3(*g*) are schematic views of the first embodiment of the invention showing the retrieval of the socket from the plug.
Figure 3B:
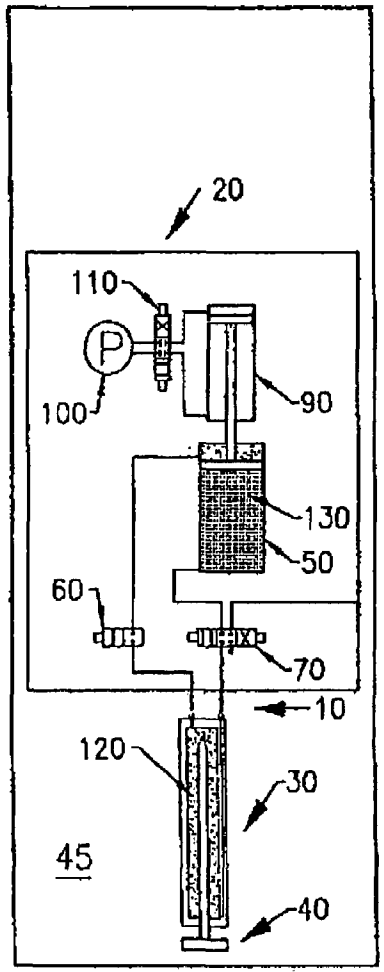
Figure 3A:
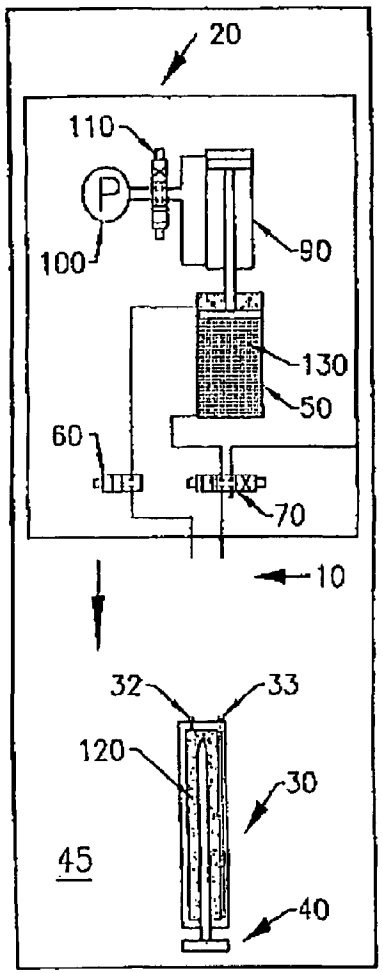
Figure 3E:
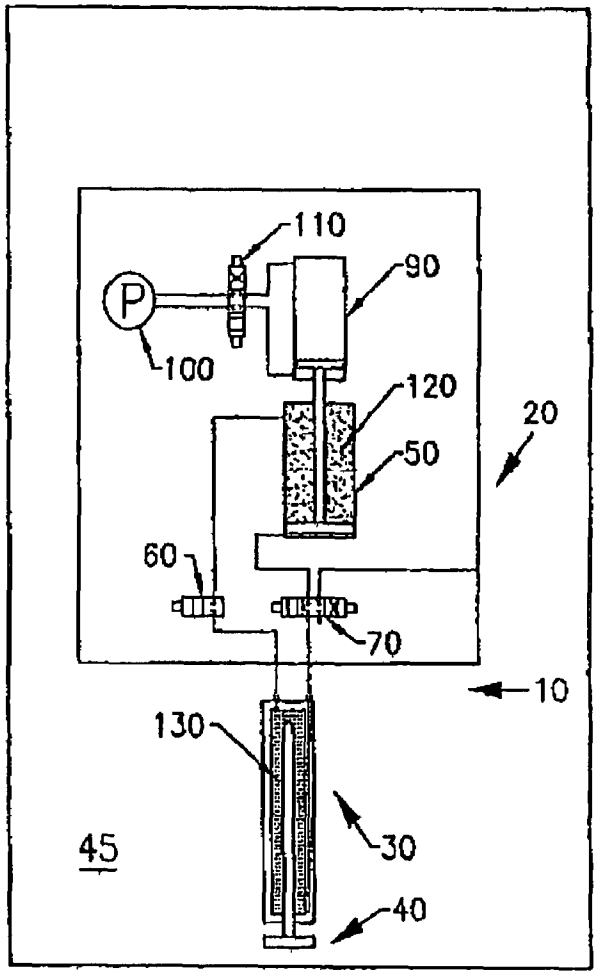
Figure 3D:
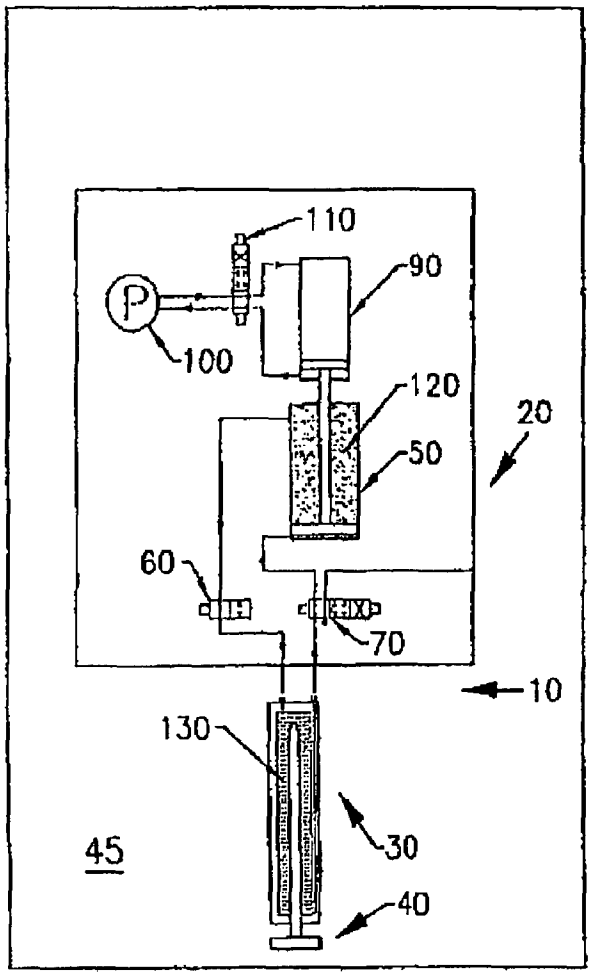
Figure 3G:
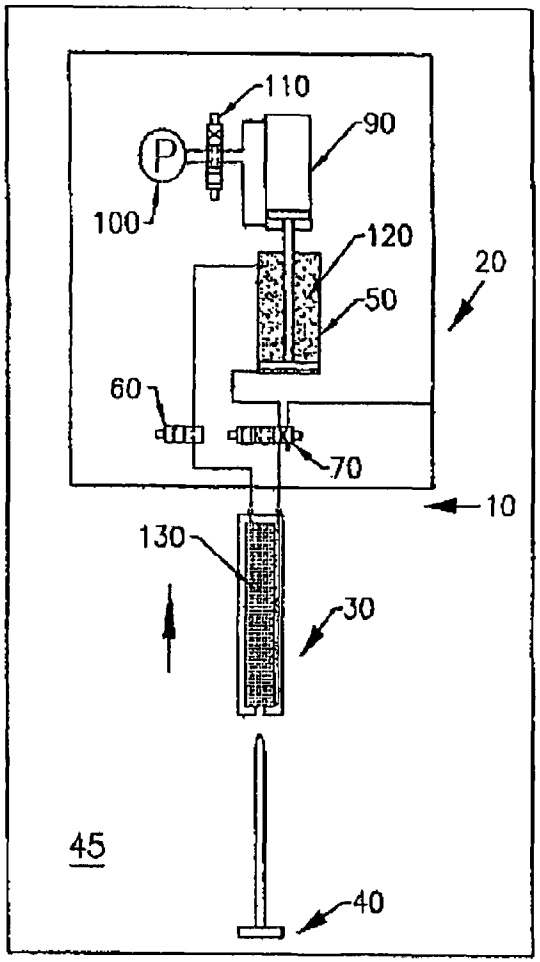
Figure 3F:
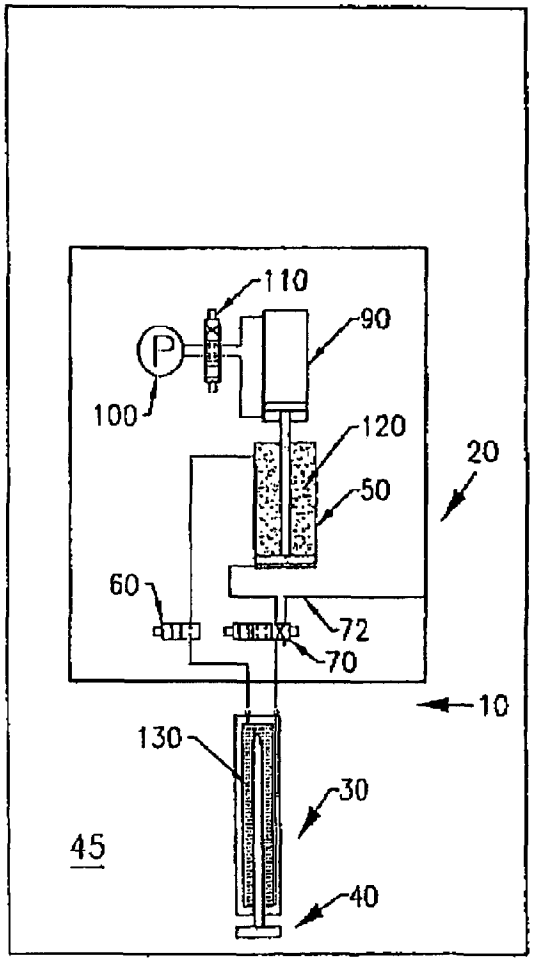

Referring to FIG. 1, an electrical connector 10 according to a first embodiment of the invention is shown. The connector comprises an external fluid exchange unit 20 with an attached socket 30. Below the connector is shown a plug 40.

The socket 30 comprises a chamber 31. A first stab connector 32 connects the top of the chamber to the external fluid exchange unit 20 above and a second stab connector 33 connects the bottom of the chamber to the fluid exchange unit. Inside the chamber are electrical contacts 36 and connected to the socket is at least one electrical cable 35. The plug 40 can enter into the chamber via an aperture surrounded by an "O" ring 34 at the base of the chamber.

The outside of the plug 40 is insulated except for where there are electrical contacts 41 for coupling with the electrical contacts 36 of the socket 30.

Inside the fluid exchange unit 20 is a fluid container 50 that is connected to the socket 30 via first and second hydraulic valves 60,70. There are two ports 52,54 on one side of the fluid container with the first port 52 located proximate the top of the container and the second port 54 located proximate the bottom of the container. A first container socket conduit 62 connects the first port to the first stab connector 32 of the socket via the first hydraulic valve 60 and a second container socket conduit 64 connects the second port to the second stab connector 33 of the socket via the second hydraulic valve 70. An ambient conduit 72 is also connected to the second hydraulic valve. The ambient conduit allows the socket to be connected to the fluid surrounding the fluid exchange unit via the part of the second container socket conduit 64 between the second stab connector 33 and the second hydraulic valve 70.

Above the fluid container 50 is an actuator cylinder 90. Contained within the fluid container is a container piston 91 and contained within the actuator cylinder is an actuator piston 92. The container piston and the actuator piston are interconnected by a connecting rod 93. There are two ports 94,95 on one side of the actuator cylinder with the first port 94 located proximate the top of the cylinder and the second port 95 located proximate the bottom of the cylinder. The actuator cylinder 90 is connected to a conventional pump 100 via an actuating valve 110 and a pump valve conduit 102 connecting the pump to the actuating valve. A first valve actuator conduit 96 connects the actuating valve to the first port of the actuator cylinder and a second valve actuator conduit 97 connects the actuating valve to the second port of the actuator cylinder.

Referring to FIGS. 2(*a*) to 2(*f*), and additionally to FIG. 1, the process of installing the socket 30 on the plug 40 in seawater 45 will be described.

[FIG. 2(*a*)] The fluid exchange unit 20 and socket 30 is moved towards the plug 40. Inside the socket is seawater 130 that is at ambient pressure. Inside the container 50, the container piston 91 is positioned slightly above the second port 54. Above the container piston is a gas, preferably air 120, at a pressure of $10^5$ Pa (1 bar). The first and second hydraulic valves 60,70 are initially configured to close first and second container socket conduits 62,64 and thus isolate the container 50. However, the second valve 70 is also configured to connect the socket to the ambient conduit 72. The actuating valve 110 is configured to close the valve actuator conduits 96,97 and hence isolate the actuator cylinder 90 from the pump 100.

[FIG. 2(*b*)] As the plug 40 enters the socket 30 via the "O" ring 34, seawater 130 is displaced from inside the socket into the sea surrounding the fluid exchange unit 20 via the part of the second container socket conduit 64 between the second stab connector 33 of the socket and the second hydraulic valve 70 and via the ambient conduit 72. This maintains the remaining seawater in the socket at ambient pressure. The electrical contacts 41 of the plug become coupled to the electrical contacts 36 of the socket once the plug has been fully inserted into the socket. However, no power is as yet supplied to this connection.

[FIG. 2(*c*)] The hydraulic valves 60,70 are then reconfigured by conventional means (not shown) to connect the socket to the fluid container 50 via first and second container socket conduits 62,64, the second hydraulic valve 70 closing the ambient conduit 72. The seawater 130 in the socket 30 is thus connected to the fluid container 50 where air 120 is contained at a pressure of $10^5$ Pa (1 bar), hence the seawater is now at a pressure of $10^5$ Pa (1 bar). The seawater in the socket is accordingly sealed from the surrounding seawater at ambient pressure as there is a pressure difference across the "O" ring 34.

[FIG. 2(*d*)] The actuating valve 110 is reconfigured in a conventional manner to connect the pump 100 to the actuator cylinder 90 via the pump valve conduit 102 and the second valve actuator conduit 97. The pump forces a pressurized liquid into the actuator cylinder via the second port 95 that is below the actuator piston 92, causing the piston to rise towards the top of the actuator cylinder 90. Liquid in the part of the actuator cylinder above the actuator piston is expelled in a known manner via the first valve actuator conduit 96 and the actuating valve. The movement of the actuator piston 92 causes the container piston 91, that is connected to the actuator piston by the connecting rod 93, to rise forcing air 120 stored in the fluid container 50 into the socket 30 via the first container socket conduit 62. The air enters the socket 30 via the first stab connector 32 at the top of the socket. This forces the seawater 130 out of the socket via the second stab connector 33 which is connected to the base of the socket and into the fluid container 50 via the second container socket conduit 64.

[FIG. 2(*e*)] The actuating valve 110 is reconfigured to isolate the pump 100 from the actuator cylinder 90. Then the hydraulic valves 60,70 are reconfigured to close the container socket conduits 62,64 between the socket 30 and the fluid container 50, isolating the socket from the fluid exchange unit 20.

[FIG. 2(*f*)] The stab connectors 32,33 disengage from the container socket conduits 62,64 of the fluid exchange unit 20 as the fluid exchange unit is lifted away from the socket 30. Power can now be applied to the electrical coupling between the plug 40 and socket in a known manner, the air in the socket being at a pressure of $10^5$ Pa (1 bar).

Referring to FIGS. 3(*a*) to 3(*g*), and additionally to FIG. 1, the process of retrieving the socket 30 from the plug 40 will be described.

[FIG. 3(*a*)] Power is switched off to the electrical coupling between the plug 40 and socket 30. The fluid exchange unit 20 is moved towards the socket and plug. The air 120 in the socket is at a pressure of $10^5$ Pa (1 bar) and the container 50 is substantially filled with water 130 at a pressure of $10^5$ Pa (1 bar).

[FIG. 3(*b*)] The fluid exchange unit 20 connects with the socket 30 as the first and second container socket conduits 62,64 engage first and second stab connectors 32,33 respectively.

[FIG. 3(*c*)] The hydraulic valves 60,70 are reconfigured to connect the socket 30 to the fluid container 50 via first and second container socket conduits 62,64.

[FIG. 3(*d*)] The actuating valve 110 is reconfigured to connect the pump 100 to the actuator cylinder 90 via the pump valve conduit 102 and the first valve actuator conduit 96. The pump forces pressurized liquid into the actuator cylinder via the first port 94, causing the actuator piston 92 to be pushed towards the base of the actuator cylinder 90. Liquid in the part of the actuator cylinder below the actuator piston is expelled via the second valve actuator conduit 97 and the actuating valve. The movement of the actuator piston pushes down the connected container piston 91, forcing seawater 130 stored in the fluid container 50 into the socket 30 via the second container socket conduit 64. This forces air 120 out of the socket and into the container 50 via the first container socket conduit 62.

[FIG. 3(*e*)] The hydraulic valves 60,70 are reconfigured to close the container socket conduits 62,64 between the socket 30 and the fluid container 50, isolating the socket from the fluid exchange unit 20. The actuating valve 110 is reconfigured to isolate the pump 100 from the actuator cylinder 90.

[FIG. 3(*f*)] The second hydraulic valve 70 is reconfigured to connect the socket 30 to the ambient conduit 72 via the part of the second container socket conduit 64 between the second stab connector 33 of the socket and the second hydraulic valve 70. This balances the pressure of the seawater 130 in the socket with the surrounding seawater. Thus, the seawater in the socket is now at ambient pressure and is accordingly no longer sealed from the surrounding seawater as there is no longer a pressure difference across the "O" ring 34.

[FIG. 3(*g*)] The fluid exchange unit 20 moves away with the retrieved socket 30 from the plug 40. The surrounding seawater is drawn into the socket as this occurs.

A second embodiment of the invention will now be described with reference to FIGS. 4 to 6(*g*). Where a part in the first embodiment has a reference numeral and there is a substantially corresponding part in the second embodiment the same reference numeral has been used except that the number two hundred has been added to the latter. Not all such parts will be described in detail.

Figure 4:
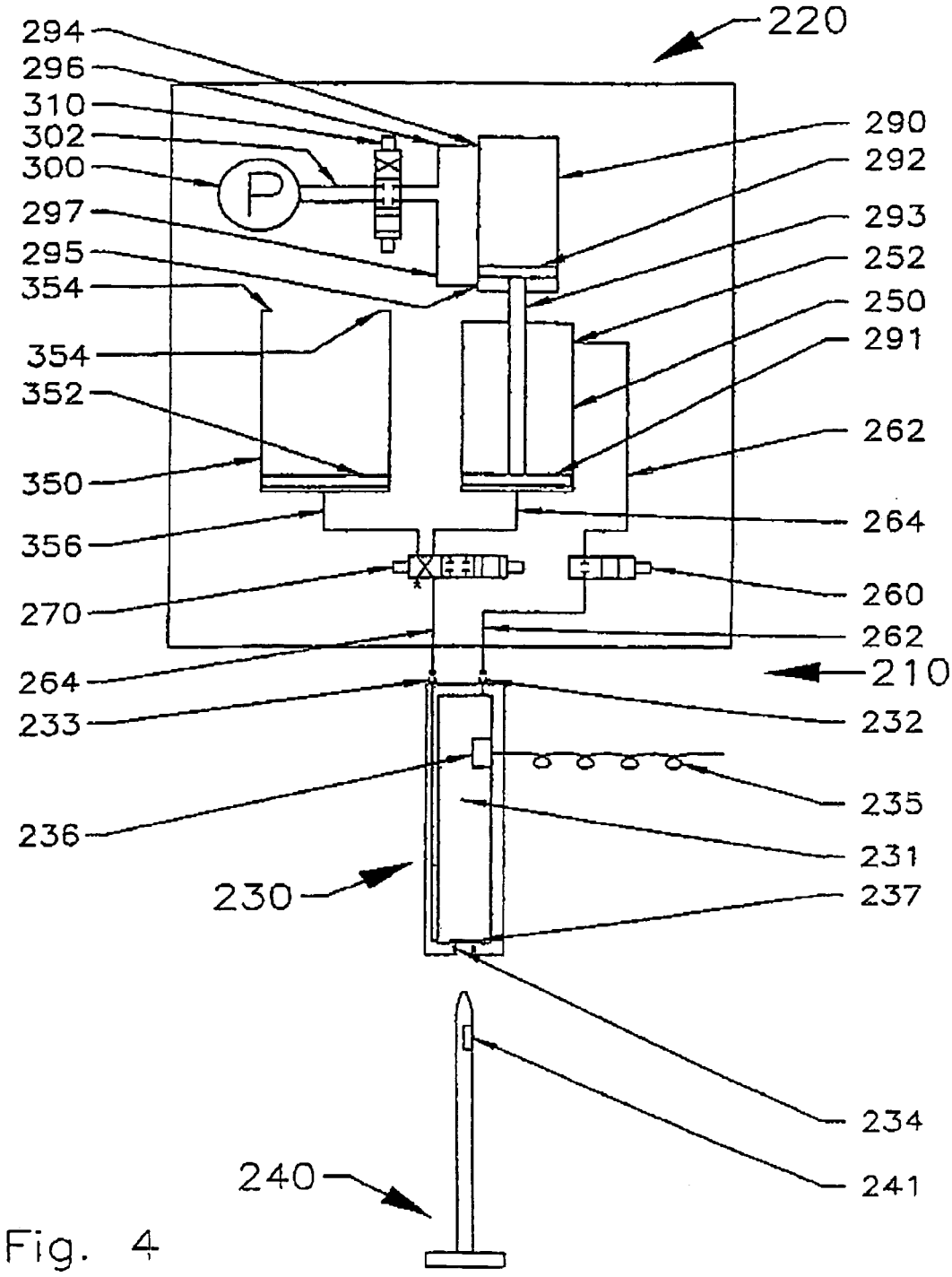
FIG. 4 is a detailed schematic view of an electrical connector and plug of a second embodiment of the invention.
Figure 5C:
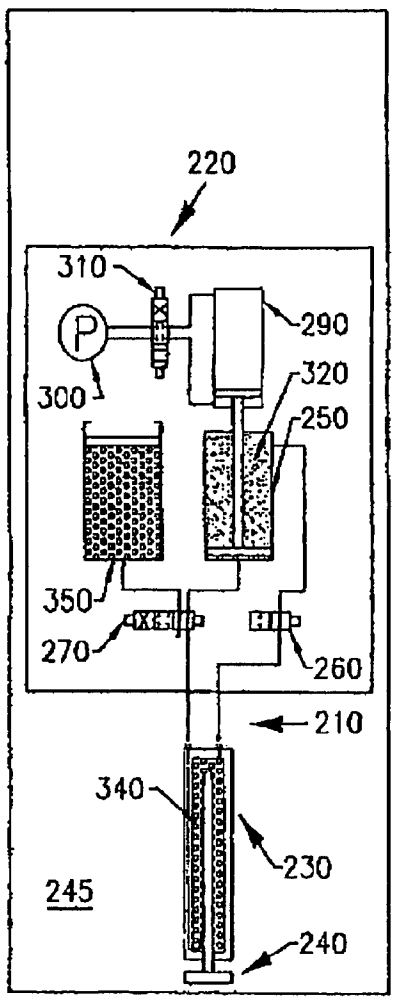
FIGS. 5(*a*) to 5(*f*) are schematic views of the second embodiment of the invention showing the installation of the socket of the connector on the plug.
Figure 5B:
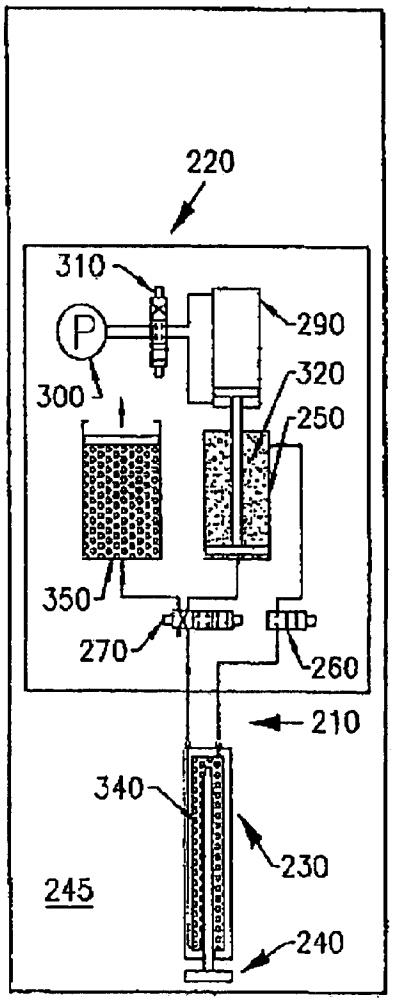
Figure 5A:
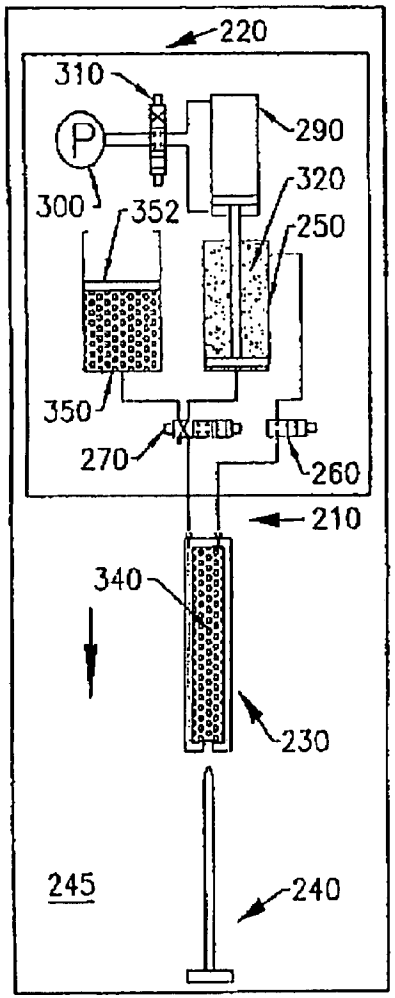
Figure 5F:
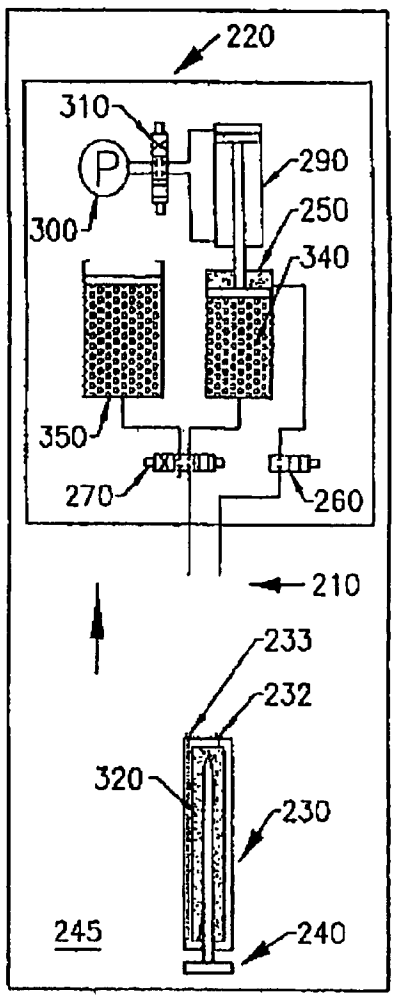
Figure 5E:
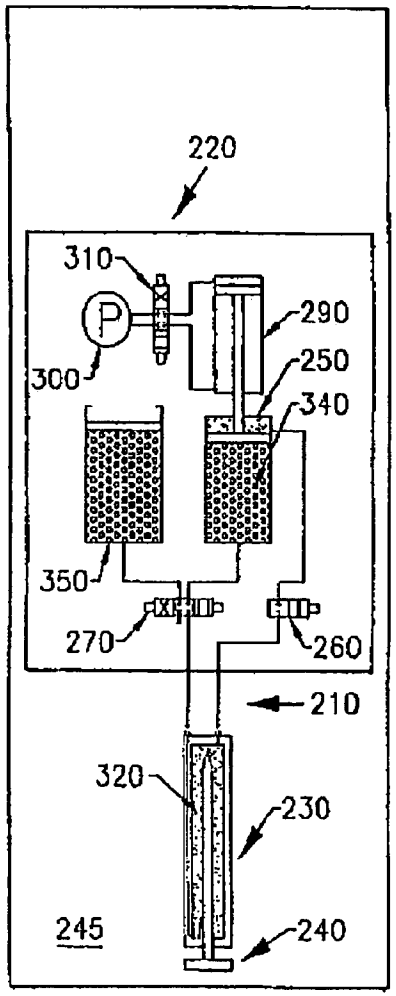
Figure 5D:
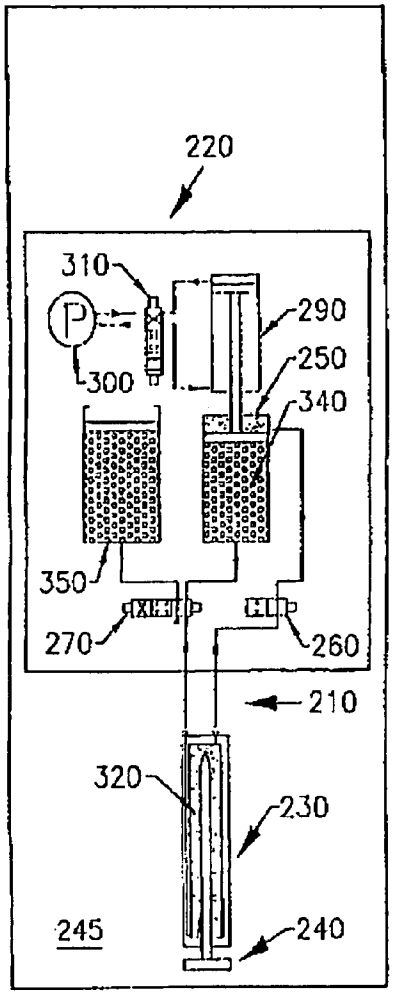
Figure 6C:
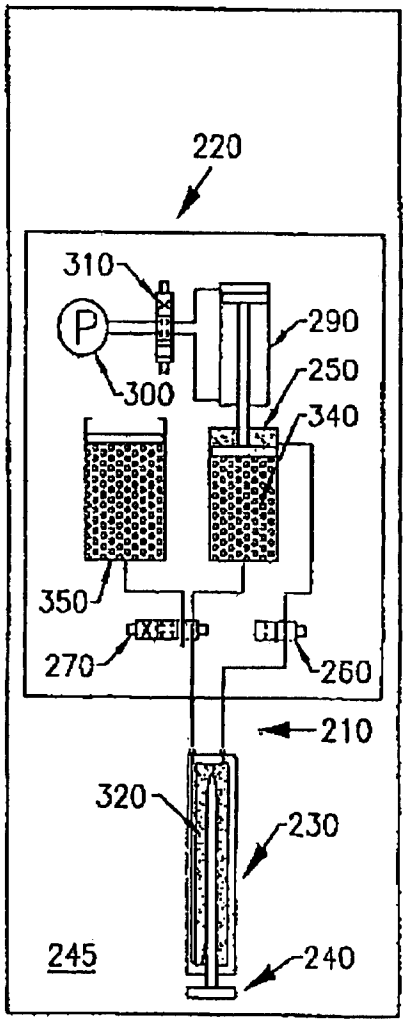
FIGS. 6(*a*) to 6(*g*) are schematic views of the second embodiment of the invention showing the retrieval of the socket from the plug.
Figure 6B:
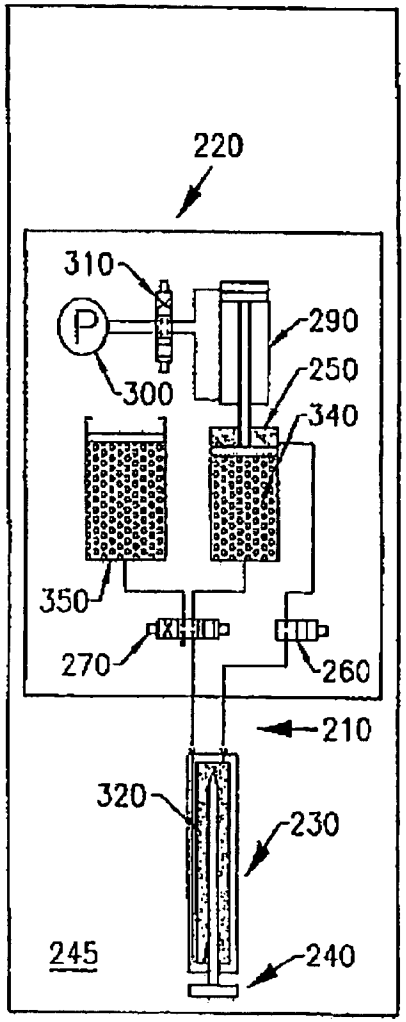
Figure 6A:
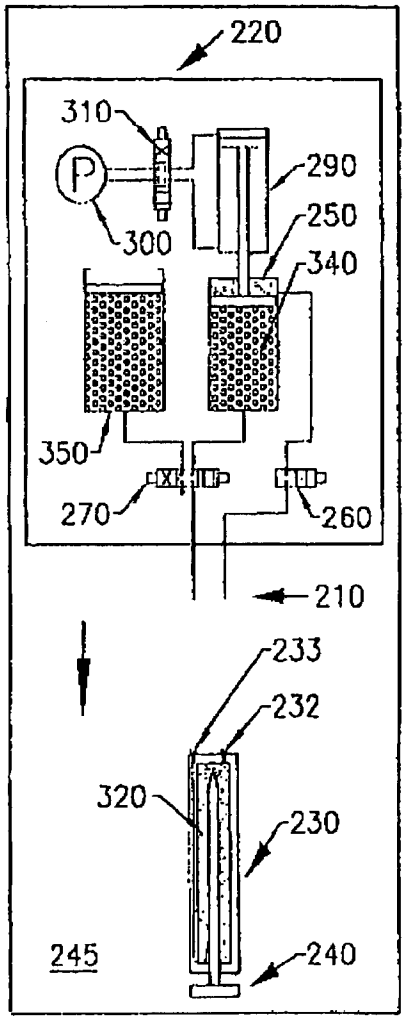
Figure 6E:
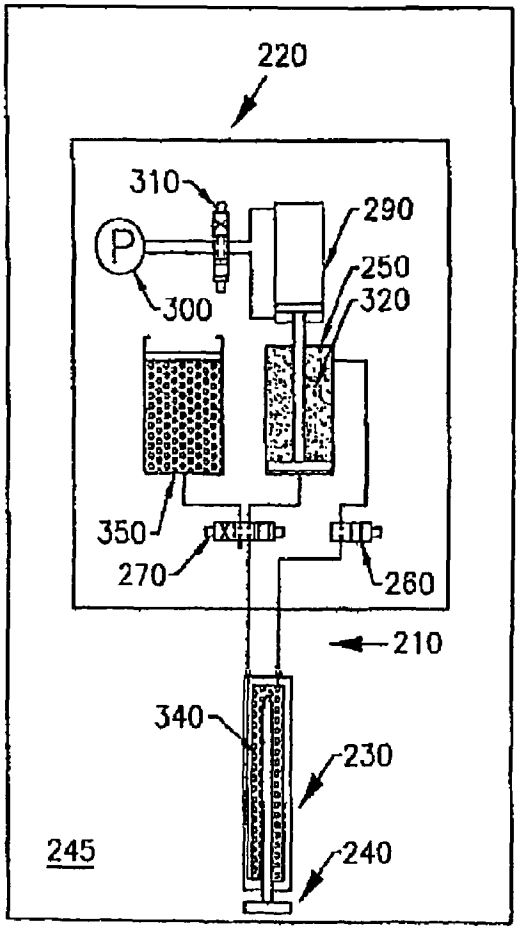
Figure 6D:
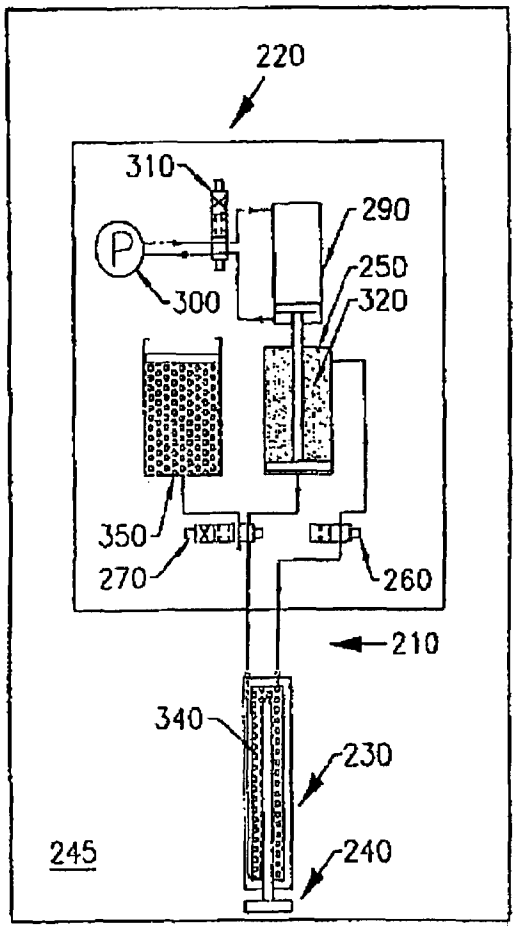
Figure 6G:
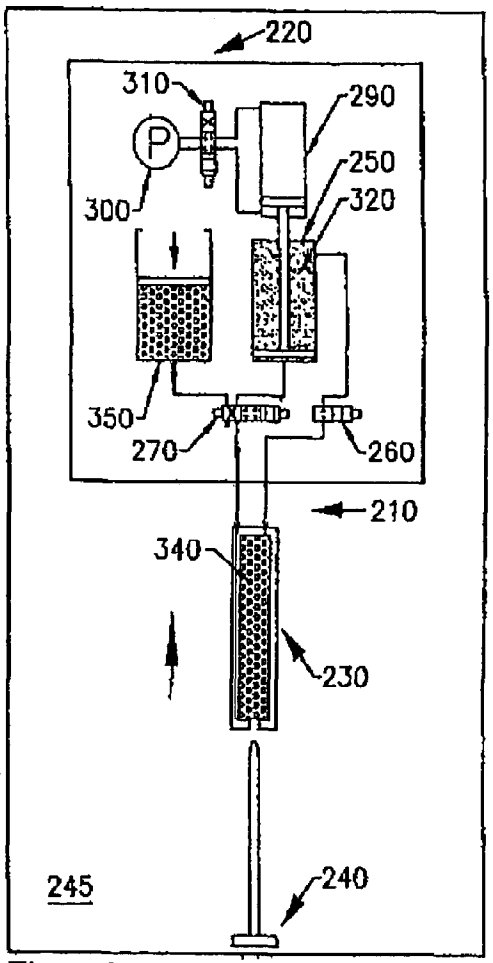
Figure 6F:
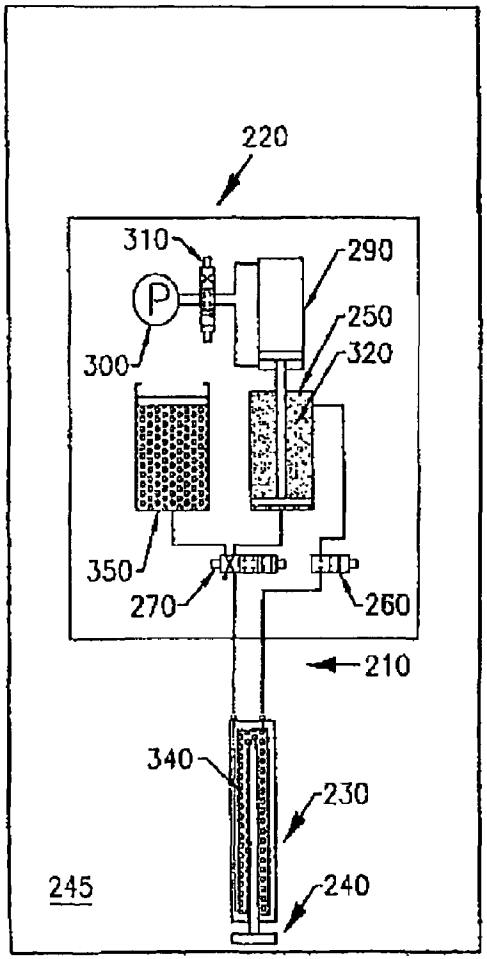

Referring to FIG. 4, an electrical connector 210 according to a second embodiment of the invention is shown. The connector comprises an external fluid exchange unit 220 with an attached socket 230. Below the connector is shown a plug 240. Both the socket and plug are the same as that described in the first embodiment except that the socket additionally has a hinged flat plate seal 237 situated above the "O" ring seal 234. The socket and plug will have mateable contacts 236 and 241 respectively.

Inside the fluid exchange unit 220 is a fluid container 250 that is connected to the socket 230 via first and second hydraulic valves 260,270 and a compensator cylinder 350 that is connected to the socket via the second hydraulic valve 270. There is a first port 252 on one side of the fluid container located proximate the top of the container. A first container socket conduit 262 connects the port to a first stab connector 232 of the socket via the first hydraulic valve 260 and a second container socket conduit 264 connects the base of the fluid container to a second stab connector 233 of the socket via the second hydraulic valve 270.

The compensator cylinder 350 is open at its top end and has a compensator piston 352 below which liquid can be stored. The piston is free to move in a direction substantially perpendicular to a central axis of the cylinder. Returns 354 at the top of the compensator cylinder retain the piston. The base of the compensator cylinder 350 is connected to the second hydraulic valve 270 via a compensator conduit 356.

Above the fluid container 250 are an actuator cylinder 290, a pump 300 and an actuating valve 310. These are the same as those described in the first embodiment and are connected in the same way.

Referring to FIGS. 5(*a*) to 5(*f*), and additionally to FIG. 4, the process of installing the socket 230 on the plug 240 in seawater 245 will be described.

[FIG. 5(*a*)] The fluid exchange unit 220 and socket 230 is moved towards the plug 240. Oil 340 initially fills the socket to protect the electrical contacts in the chamber 231 and keeps them clean although other fluids could be used. The space below the compensator piston 352 is also filled with oil. The oil is sealed from the seawater surrounding the socket by the hinged flat plate seal 237 being in its closed position over the "O" ring 234. Inside the container 250, the container piston 291 is positioned slightly above the base of the container. Above the container piston 291 is a gas, preferably air 320, at a pressure of $10^5$ Pa (1 bar). The first and second hydraulic valves 260,270 are initially configured to close first and second container socket conduits 262,264 to isolate the socket 230 from the container 250. The compensator cylinder 350 contains oil below the compensator piston 352. As the compensator piston 352 is free to move in a direction substantially perpendicular to the axis of the cylinder, the oil below the compensator piston is at ambient pressure. The second valve 270 is also configured to connect the socket to the compensator cylinder via the part of the second container socket conduit between the second stab connector 233 and the second hydraulic valve and via the compensator conduit 356. Thus the oil inside the socket is pressure balanced with the oil inside the compensator cylinder and so is also at ambient pressure. The actuating valve 310 is reconfigured to close the valve actuator conduits 296,297 and hence isolate the actuator cylinder 290 from the pump 300.

[FIG. 5(*b*)] As the plug 240 enters the socket 230 via the "O" ring 234, the seal plate 237 is pushed open and leans on the inserted plug. Oil 340 is displaced from inside the socket 230 by the plug and into the compensator cylinder 350 via the part of the second container socket conduit 264 between the second stab connector 233 of the socket and the second hydraulic valve 270 and via the compensator conduit 356. This increases the amount of oil beneath the compensator piston 352 in the compensator cylinder, raising the piston and thus maintaining the oil remaining in the socket 230 at ambient pressure. The electrical contacts 241 of the plug 240 become coupled to the electrical contacts 236 of the socket 230 once the plug has been fully inserted into the socket. However, no power is as yet supplied to this connection.

[FIG. 5(*c*)] The hydraulic valves 260,270 are then reconfigured by conventional means (not shown) to connect the socket 230 to the fluid container 250 via first and second container socket conduits 262,264, the second hydraulic valve 270 closing the compensator conduit 356. The oil 340 in the socket is thus connected to the fluid container 250 where air 320 is contained at a pressure of $10^5$ Pa (1 bar) above the container piston 291. Hence the oil in the socket is now at a pressure of 105 Pa (1 bar). The oil in the socket is accordingly sealed from the surrounding seawater at ambient pressure as there is a pressure difference across the "O" ring 234.

[FIG. 5(*d*)] The actuating valve 310 is reconfigured in a conventional manner to connect the pump 300 to the actuator cylinder 290 via the pump valve conduit 302 and the second valve actuator conduit 297. The pump forces a pressurized liquid into the actuator cylinder via the second port 295, that is below the actuator piston 292, causing the actuator piston to rise towards the top of the actuator cylinder 290. Liquid in the part of the actuator cylinder above the actuator piston is expelled in a known manner via the first valve actuator conduit 296 and the actuating valve. The movement of the actuator piston causes the container piston 291, that is connected to the actuator piston by the connecting rod 293, to rise, forcing air 320 stored in the fluid container 250 into the socket 230 via the first container socket conduit 262. The air enters the socket 230 via the first stab connector 232 at the top of the socket. This forces the oil 340 out of the socket via the second stab connector 233 at the base of the socket and into the fluid container via the second container socket conduit 264.

[FIG. 5(*e*)] The actuating valve 310 is reconfigured to isolate the pump 300 from the actuator cylinder 290. The hydraulic valves 260,270 are reconfigured to close the container socket conduits 262,264 and isolate the socket 230 from the fluid container 250 and the compensator cylinder 350 thus totally isolating the socket 230 from the fluid exchange unit 220.

[FIG. 5(*f*)] The stab connectors 232,233 disengage from the container socket conduits 262,264 of the fluid exchange unit 220 and the fluid exchange unit moves away from the socket 230. Power can now be applied to the electrical coupling between the plug 240 and socket 230 in a known manner, the air in the socket being at a pressure of 105 Pa (1 bar).

Referring to FIGS. 6(*a*) to 6(*g*), and additionally to FIG. 4, the process of retrieving the socket 230 from the plug 240 will be described.

[FIG. 6(*a*)] Power is switched off to the electrical coupling between the plug 240 and socket 230. The fluid exchange unit 220 is moved towards the engaged socket 230 and plug 240. The air 320 in the socket is at a pressure of $10^5$ Pa (1 bar).

[FIG. 6(*b*)] The fluid exchange unit 220 connects with the socket 230 as the first and second container socket conduits 262,264 engage first and second stab connectors 232,233 respectively.

[FIG. 6(*c*)] The hydraulic valves 260,270 are reconfigured to connect the socket 230 to the fluid container 250 via first and second container socket conduits 262,264. The air 320 in the socket 230 is connected to the fluid container 250 where oil 340 is contained at a pressure of $10^5$ Pa (1 bar) below the container piston 291.

[FIG. 6(*d*)] The actuating valve 310 is reconfigured to connect the pump 300 to the actuator cylinder 290 via the pump valve conduit 302 and the first valve actuator conduit 296. The pump forces pressurized liquid into the actuator cylinder via the first port 294, causing the actuator piston 292 to be pushed towards the base of the actuator cylinder 290. Liquid in the part of the actuator cylinder below the actuator piston is expelled via the second valve actuator conduit 297 and the actuating valve 310. The movement of the actuator piston pushes down the connected container piston 291, forcing oil 340 stored in the fluid container 250 into the socket 230 via the second container socket conduit 264. This forces air 320 out of the socket and into the container 250 via the first container socket conduit 262.

[FIG. 6(*e*)] The actuating valve 310 is reconfigured to isolate the pump 300 from the actuator cylinder 290. The hydraulic valves 260,270 are reconfigured to close the container socket conduits 262,264 isolating the socket 230 from the fluid container 250 and the compensator cylinder 350 thus totally isolating the socket 230 from the fluid exchange unit 220.

[FIG. 6(*f*)] The second hydraulic valve 270 is reconfigured to connect the socket 230 to the compensator cylinder 350 via the part of the second container socket conduit 264 between the second stab connector 233 of the socket and the second hydraulic valve 270 and via the compensator conduit 356. This balances the pressure of the oil 340 in the socket with the oil in the compensator cylinder 350. Thus, the oil in the socket 230 is now at ambient pressure and there is no longer a pressure difference across the "O" ring 234. However, the inserted plug prevents oil escaping into the surrounding seawater.

[FIG. 6(*g*)] The fluid exchange unit 220 moves away with the retrieved socket 230 from the plug 240 and oil is drawn into the socket from the compensator cylinder 350, lowering the compensator piston 352. The hinged flat plate seal 237, which had been leaning on the inserted plug, is closed by force of gravity as the plug is withdrawn.

A third embodiment of the invention will now be described with reference to FIGS. 7 to 9(*g*). Where a part in the first embodiment has a reference numeral and there is a substantially corresponding part in the third embodiment the same reference numeral has been used except that the number four hundred has been added to the latter. Not all such parts will be described in detail.

Figure 7:
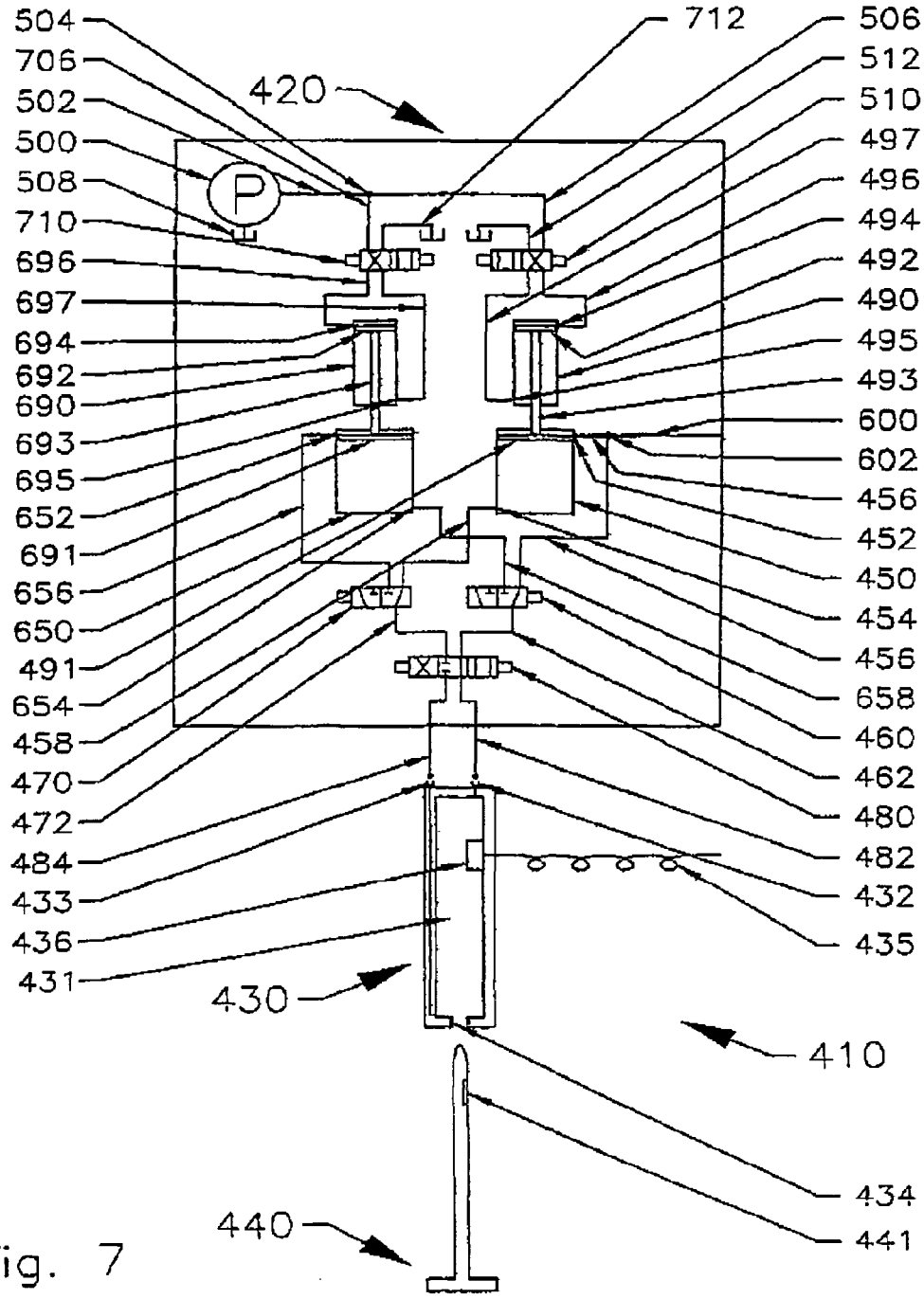
FIG. 7 is a detailed schematic view of an electrical connector and plug of a third embodiment of the invention.
Figure 8C:
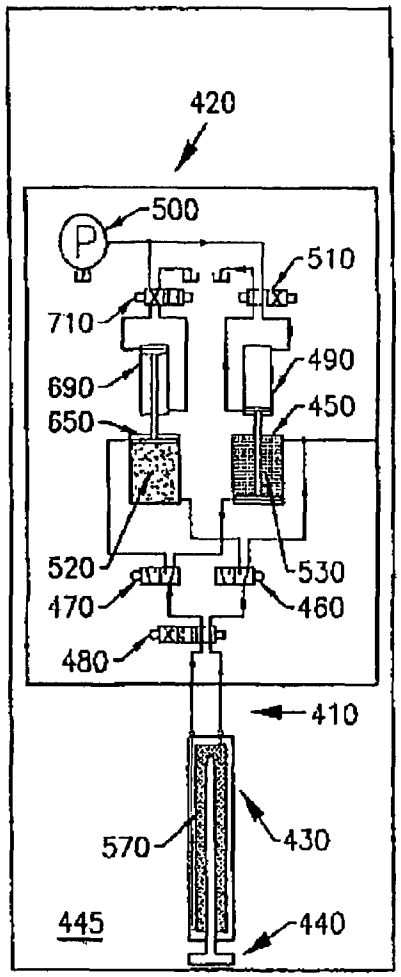
FIGS. 8(*a*) to 8(*g*) are schematic views of the third embodiment of the invention showing the installation of the socket of the connector on the plug.
Figure 8B:
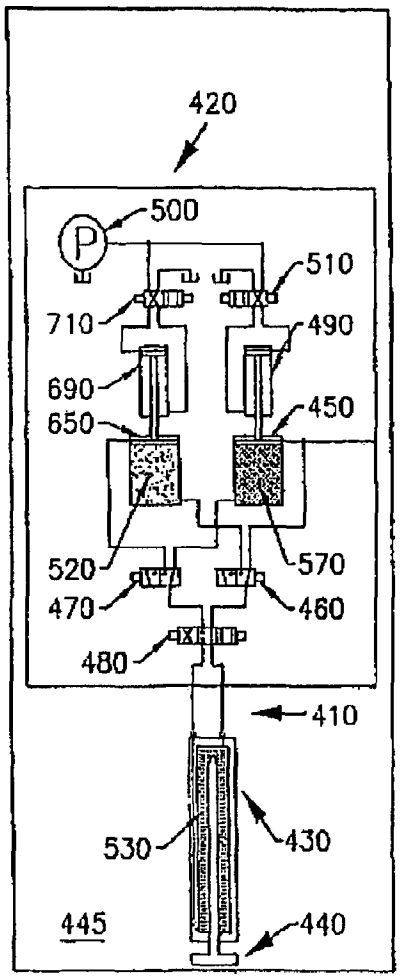
Figure 8A:
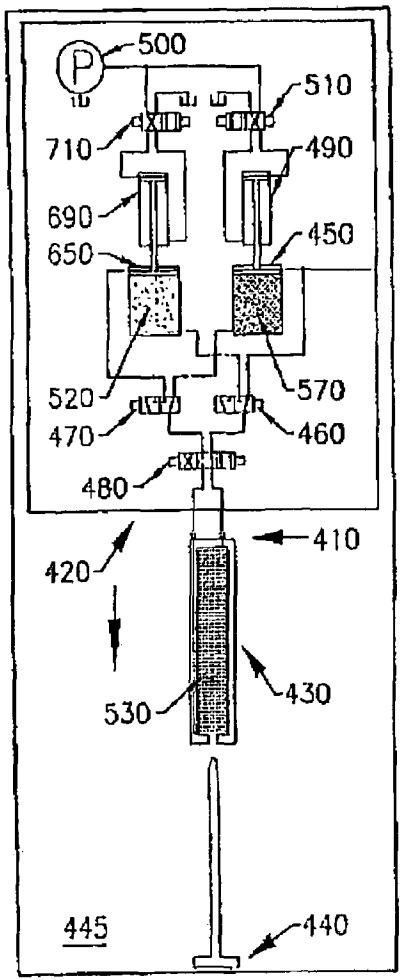
Figure 8E:
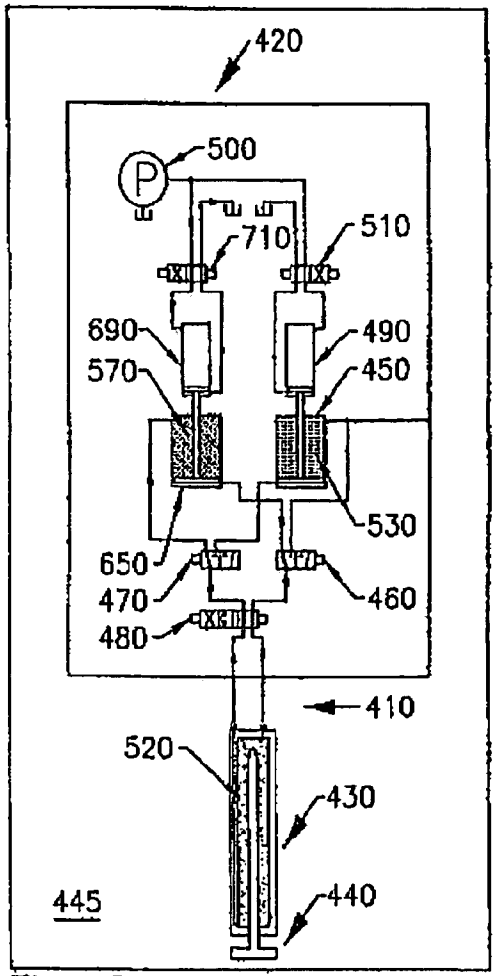
Figure 8D:
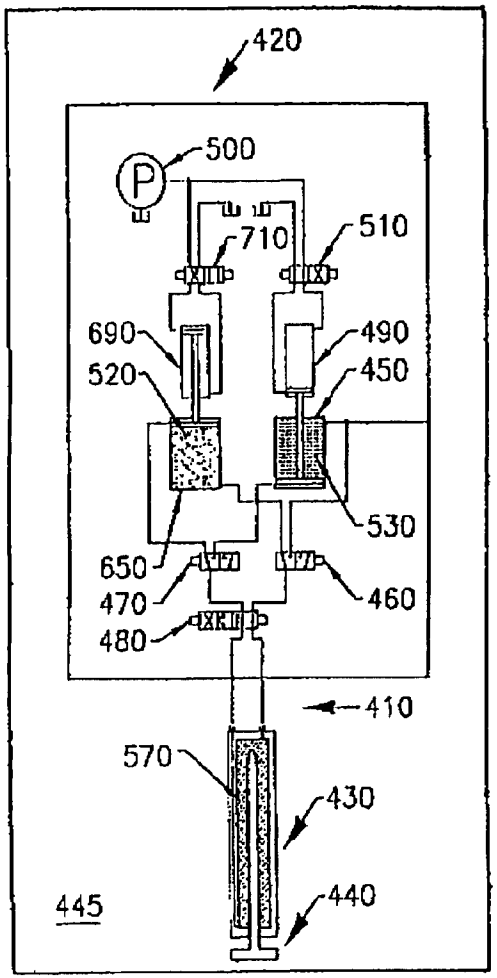
Figure 8G:
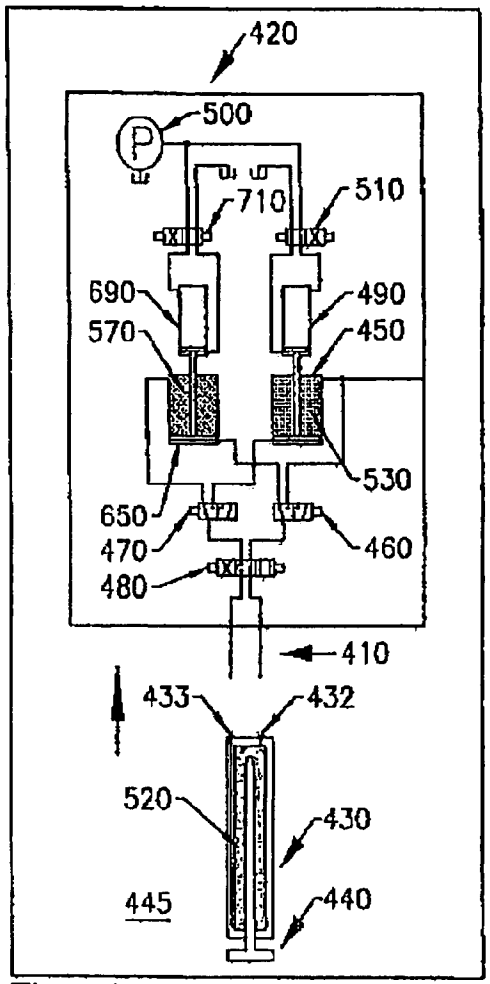
Figure 8F:
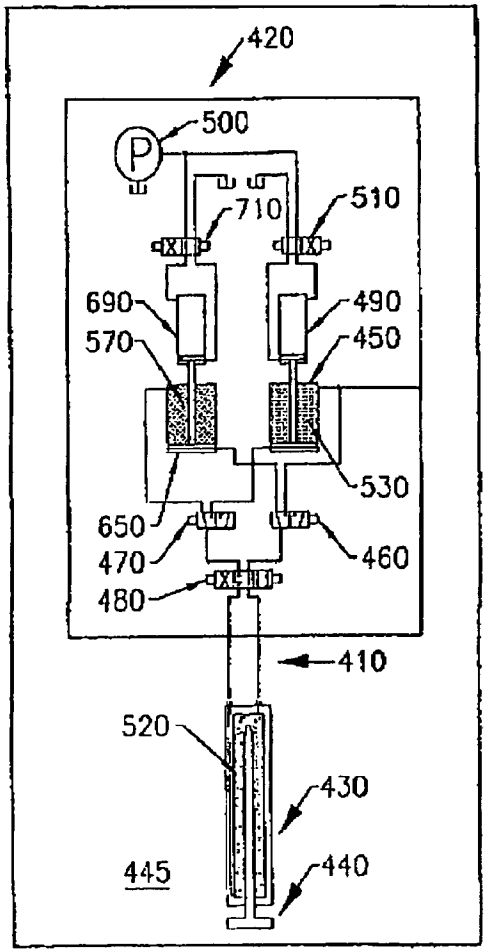
Figure 9C:
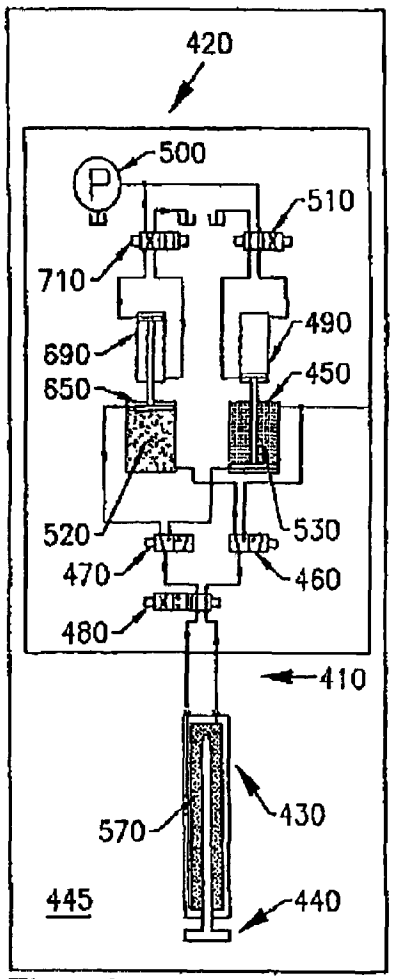
FIGS. 9(*a*) to 9(*g*) are schematic views of the third embodiment of the invention showing the retrieval of the socket from the plug.
Figure 9B:
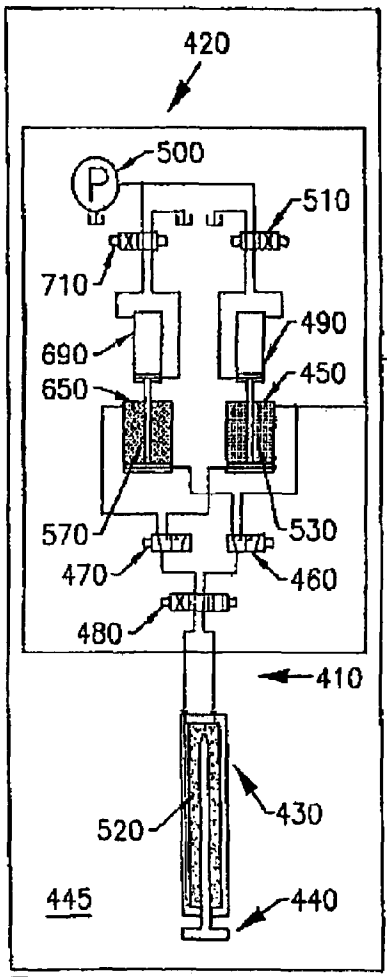
Figure 9A:
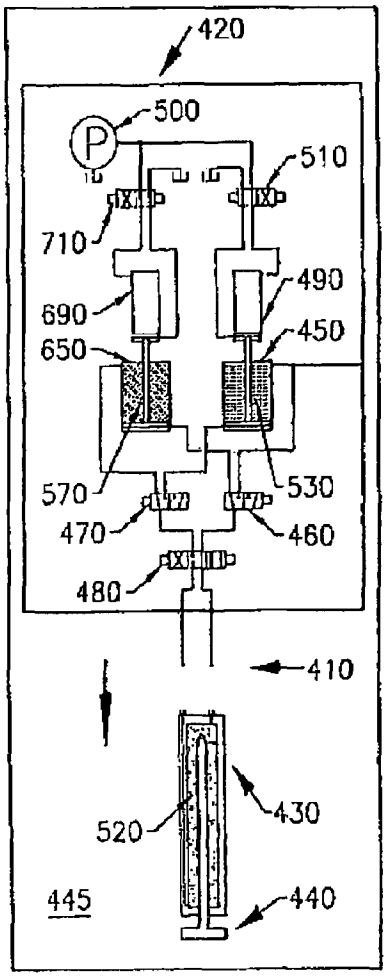
Figure 9E:
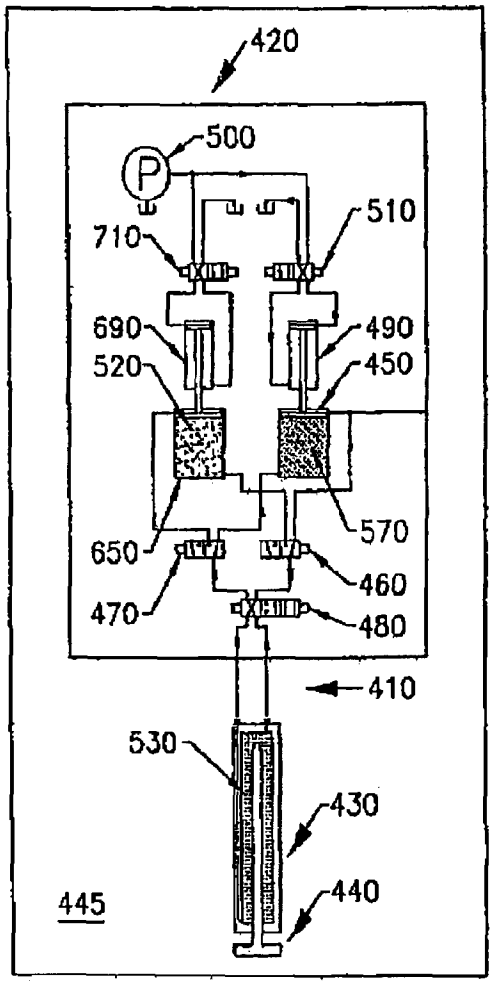
Figure 9D:
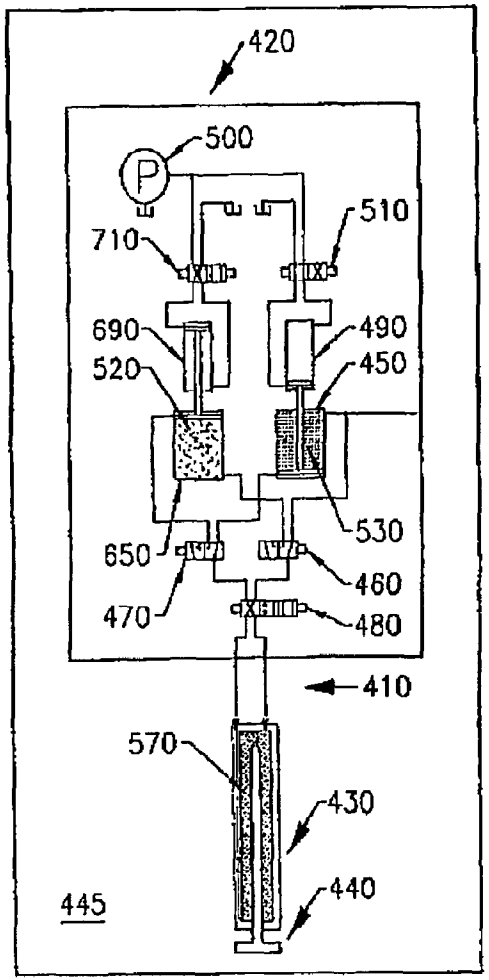
Figure 9G:
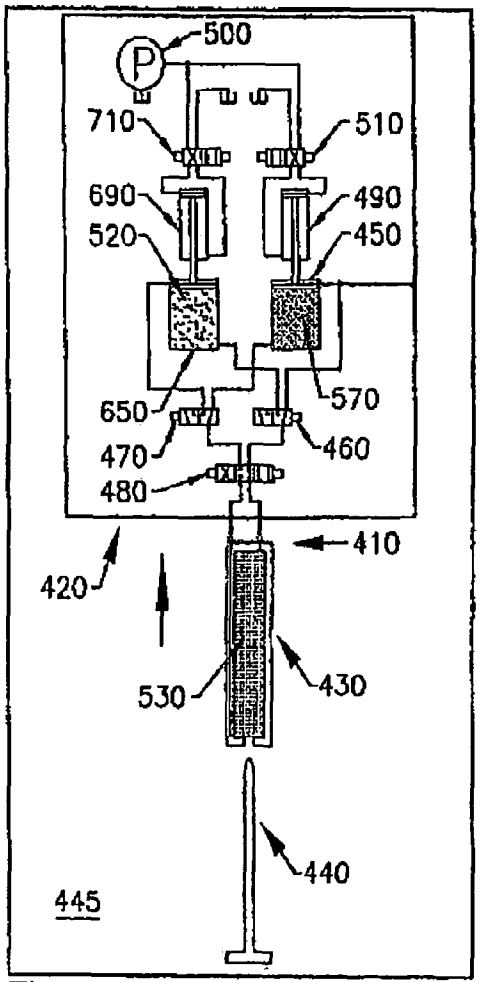
Figure 9F:
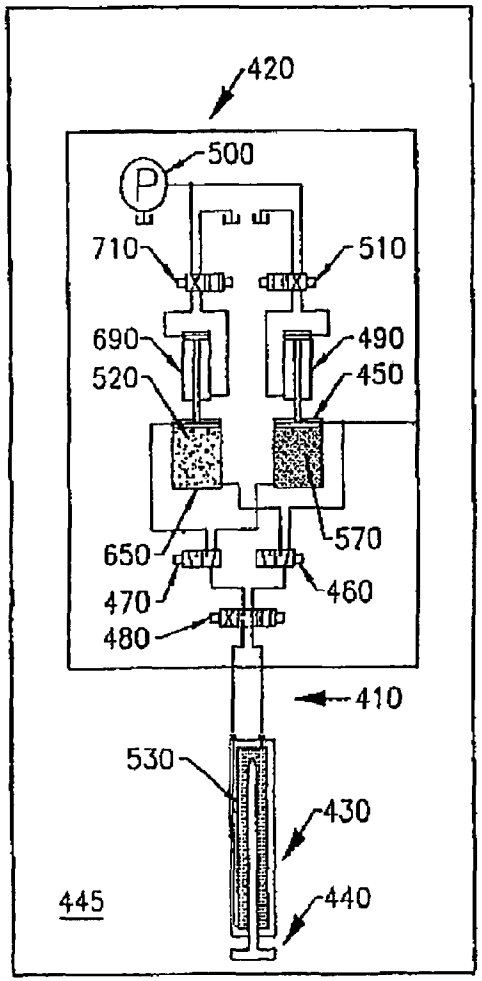

Referring to FIG. 7, an electrical connector 410 according to a third embodiment of the invention is shown. The connector comprises an external fluid exchange unit 420 with an attached socket 430. Below the socket 430 is shown a plug 440 having electrical contacts 436 and 441 respectively. Both the socket and plug are the same as that described in the first embodiment.

Inside the fluid exchange unit 420 are first and second fluid containers 450,650 that are connected to the socket 430 via first, second and third hydraulic valves 460,470,480. There are two ports 452,454 on one side of the first fluid container 450 with the first port 452 located proximate the top of the container and the second port 454 located proximate the bottom of the container. There are two ports 652,654 similarly located on the second fluid container 650. A first container first valve conduit 456 connects the first port 452 of the first fluid container 450 to the first hydraulic valve 460 and a first container second valve conduit 458 connects the second port 454 of the first fluid container 450 to the second hydraulic valve 470. An ambient conduit 600 is connected by a junction 602 to the first container first valve conduit 456. The ambient conduit 600 provides a connection to the fluid surrounding the fluid exchange unit. A second container second valve conduit 656 connects the first port 652 of the second fluid container 650 to the second hydraulic valve 470 and a second container first valve conduit 658 connects the second port 654 of the second fluid container 650 to the first hydraulic valve 460. The first hydraulic valve 460 is connected to the third hydraulic valve 480 by a first valve third valve conduit 462 and the second hydraulic valve 470 is connected to the third hydraulic valve 480 by a second valve third valve conduit 472. The third hydraulic valve is connected to the first and second stab connectors 432,433 of the socket by first and second stab connector conduits 482,484 respectively.

Above the fluid containers 450,650 are first and second actuator cylinders 490,690. Contained within the first fluid container 450 is a first container piston 491 and contained within the first actuator cylinder is a first actuator piston 492. The first container piston 491 and the first actuator piston 492 are interconnected by a first connecting rod 493. There are two ports 494,495 on one side of the first actuator cylinder 490 with the first port 494 located proximate the top of the first actuator cylinder and the second port 495 located proximate the bottom of the first actuator cylinder. Similarly, the second fluid container 650 contains a second container piston 691 and the second actuator cylinder 690 contains a second actuator piston 692 with these pistons being interconnected by a second connecting rod 693. There are also two ports 694,695 on one side of the second actuator cylinder 690 with the first port 694 located proximate the top of the second actuator cylinder and the second port 695 located proximate the bottom of the second actuator cylinder. The first and second actuator cylinders 490,690 are connected to a conventional pump 500 via first and second actuating valves 510,710 respectively. The pump has an exhaust outlet 508. A pump junction conduit 502 connects the pump to a junction 504. The junction is connected to the first and second actuating valves by first and second actuating valve conduits 506,706 respectively. A first valve first port conduit 496 connects the first actuating valve 510 to the first port 494 of the first actuator cylinder 490 and a first valve second port conduit 497 connects the first actuating valve 510 to the second port 495 of the first actuator cylinder 490. Similarly, a second valve first port conduit 696 connects the second actuating valve 710 to the first port 694 of the second actuator cylinder 690 and a second valve second port conduit 697 connects the second actuating valve 710 to the second port 695 of the second actuator cylinder 690. Each actuating valve 510,710 has a respective exhaust outlet 512,712.

Referring to FIGS. 8(*a*) to 8(*g*), and additionally to FIG. 7, the process of installing the socket 430 on the plug 440 in seawater 445 will be described.

[FIG. 8(*a*)] The fluid exchange unit 420 and socket 430 is moved towards the plug 440. Inside the socket is seawater 530 that is at ambient pressure. Inside the first fluid container 450, the first container piston 491 is positioned slightly below the first port 452. Below the first container piston 491 is freshwater 570 that will be used for flushing purposes, although other fluids could be used. Inside the second fluid container 650, the second container piston 691 is positioned slightly below the first port 652. Below the second container piston 691 is a gas, preferably air 520, at a pressure of $10^5$ Pa (1 bar). The hydraulic valves 460,470,480 are initially configured to isolate the socket from the first and second fluid containers 450,650 by the first valve 460 closing the second container first valve conduit 658, the second valve 470 closing second container second valve conduit 656 and the third valve 480 closing the second valve third valve conduit 472. However, the first and third hydraulic valves 460,480 are also configured to connect the socket to the ambient conduit 600 via the part of the first container first valve conduit 456 between the junction 602 and the first valve 460, the first valve third valve conduit 462 and the first stab connector conduit 482, thus connecting the socket with the seawater surrounding the fluid exchange unit. The position of the first container piston 491 isolates the freshwater 570 in the first fluid container 450 from seawater from the socket or the ambient conduit 600. The first and second actuating valves 510,710 are configured to connect the pump 500 to the second ports 495,695 at the bottom of the first and second actuator cylinders 490,690 respectively. Thus, the pump cannot push down either the first or second actuator pistons 492,692 as any pressurized liquid pumped into either cylinder will only try to force the respective piston further up.

[FIG. 8(*b*)] As the plug 440 enters the socket 430 via the "O" ring 434, seawater 530 is displaced from inside the socket into the sea surrounding the fluid exchange unit 420 via the first stab connector conduit 482, the first valve third valve conduit 462, the part of the first container first valve conduit 456 between the junction 602 and the first hydraulic valve 460, and the ambient conduit 600. This maintains the remaining seawater in the socket at ambient pressure. The electrical contacts 441 of the plug 440 become coupled to the electrical contacts 436 of the socket 430 once the plug has been fully inserted into the socket. However, no power is as yet supplied to this connection.

[FIG. 8(*c*)] The hydraulic valves 460,470,480 are then reconfigured by conventional means (not shown) to connect the first stab connector 432 of the socket 430 to the first port 452 of the first fluid container 450 via the first stab connector conduit 482, the first valve third valve conduit 462, and the first container first valve conduit 456, and to connect the second stab connector 433 to the second port 454 of the first fluid container 450 via the second stab connector conduit 484, the second valve third valve conduit 472, and the first container second valve conduit 458. The first actuating valve 510 is reconfigured in a conventional manner to connect the pump 500 to the first actuator cylinder 490. The pump forces a pressurized liquid into the first port 494 of the first actuator cylinder 490 that is above the first actuator piston 492 via the pump junction conduit 502, the first actuating valve conduit 506 and the first valve first port conduit 496. This pushes the first actuator piston 492 towards the base of the first actuator cylinder 490. Liquid in the first actuator cylinder below the first actuator piston is expelled in a known manner via the first valve second port conduit 497, the first actuating valve 510 and its associated exhaust outlet 512. The movement of the first actuator piston 492 pushes down the first container piston 491, connected to the first actuator piston 492 by the first connecting rod 493, forcing the freshwater 570 stored in the first fluid container 450 into the socket via the first container second valve conduit 458, the second valve third valve conduit 472 and the second stab connector conduit 484. The freshwater 570 enters the socket via the second stab connector 433 at the base of the socket. This forces the seawater 530 out of the socket via the first stab connector 432 at the top of the socket and into the first fluid container 450 via the first stab connector conduit 482, the first valve third valve conduit 462 and the first container first valve conduit 456.

[FIG. 8(*d*)] The first and second hydraulic valves 460,470 are then reconfigured to connect the first stab connector 432 of the socket 430 to the second port 654 of the second fluid container 650 via the first stab connector conduit 482, the first valve third valve conduit 462, and the second container first valve conduit 658, and to connect the second stab connector 433 to the first port 652 of the second fluid container 650 via the second stab connector conduit 484, the second valve third valve conduit 472, and the second container second valve conduit 656. The freshwater 570 in the socket is thus connected to the second fluid container where air 520 is contained at a pressure of $10^5$ Pa (1 bar), hence the freshwater is now at a pressure of $10^5$ Pa (1 bar). The freshwater in the socket is accordingly sealed from the surrounding seawater at ambient pressure as there is a pressure difference across the "O" ring 434.

[FIG. 8(*e*)] The second actuating valve 710 is reconfigured in a conventional manner to connect the pump 500 to the second actuator cylinder 690. The pump forces pressurized liquid into the first port 694 of the second actuator cylinder above the second actuator piston 692 via the pump junction conduit 502, the second actuating valve conduit 706 and the second valve first port conduit 696. This pushes the second actuator piston 692 towards the base of the second actuator cylinder 690. Liquid in the second actuator cylinder below the second actuator piston is expelled in a known manner via the second valve second port conduit 697, the second actuating valve 710 and its associated exhaust outlet 712. The movement of the second actuator piston 692 pushes down the second container piston 691, connected to the second actuator piston by the second connecting rod 693, forcing the air 520 stored in the second fluid container 650 into the socket via the second container first valve conduit 658, the first valve third valve conduit 462 and the first stab connector conduit 482. The air enters the socket via the first stab connector 432 at the top of the socket. This forces the freshwater 570 out of the socket via the second stab connector 433 via the base of the socket and into the second fluid container 650 via the second stab connector conduit 484, the second valve third valve conduit 472 and the second container second valve conduit 656.

[FIG. 8(*f*)] The third hydraulic valve 480 is reconfigured to isolate the socket from the fluid exchange unit 420. The first and second hydraulic valves 460, 470 are already configured to isolate the first fluid container 450 closing the first container first valve conduit 456 and the first container second valve conduit 458. The third hydraulic valve 480 closes the second valve third valve conduit 472 isolating the first port 652 of the second fluid container 650. The second container piston 652 is positioned at the base of the second fluid container thus sealing the second port 654 of the second fluid container.

[FIG. 8(*g*)] The stab connectors 432,433 disengage from the stab connector conduits 482,484 of the fluid exchange unit 420 and the fluid exchange unit moves away from the socket 430. Power can now be applied to the electrical coupling between the plug 440 and socket in a known manner, the air in the socket being at a pressure of $10^5$ Pa (1 bar).

Referring to FIGS. 9(*a*) to 9(*g*), and additionally to FIG. 7, the process of retrieving the socket 430 from the plug 440 will be described.

[FIG. 9(*a*)] Power is switched off to the electrical coupling between the plug 440 and socket 430. The fluid exchange unit 420 is moved towards the socket and plug. The air 520 in the socket is at a pressure of $10^5$ Pa (1 bar).

[FIG. 9(*b*)] The fluid exchange unit 420 connects with the socket 430 as the first and second stab connector conduits 482,484 engage first and second stab connectors 432,433 respectively.

[FIG. 9(*c*)] The third hydraulic valve 480 is configured to connect the first stab connector 432 of the socket 430 to the second port 654 of the second fluid container 650 via the first stab connector conduit 482, the first valve third valve conduit 462, and the second container first valve conduit 658, and to connect the second stab connector 433 to the first port 652 of the second fluid container via the second stab connector conduit 484, the second valve third valve conduit 472, and the second container second valve conduit 656. The second actuating valve 710 is reconfigured to connect the pump 500 to the second actuator cylinder 690. The pump forces pressurized liquid into the second port 695 of the second actuator cylinder 690 below the second actuator piston 692 via the pump junction conduit 502, the second actuating valve conduit 706 and the second valve second port conduit 697. This forces the second actuator piston 692 up towards the top of the second actuator cylinder 690. Liquid in the second actuator cylinder above the second actuator piston is expelled via the second valve first port conduit 696, the second actuating valve and its associated exhaust outlet 712. The movement of the second actuator piston pulls the connected second container piston 691 upwards, forcing the freshwater 570 stored in the second fluid container 650 into the socket via the second container second valve conduit 656, the second valve third valve conduit 472 and the second stab connector conduit 484. This forces the air 520 out of the socket and into the second fluid container via the first stab connector conduit 482, the first valve third valve conduit 462 and the second container first valve conduit 656.

[FIG. 9(*d*)] The hydraulic valves 460,470,480 are then reconfigured to connect the first stab connector 432 of the socket 430 to the second port 454 of the first fluid container 450 via the first stab connector conduit 482, the second valve third valve conduit 472 and the first container second valve conduit 458, and to connect the second stab connector 433 to the first port 452 of the first fluid container via the second stab connector conduit 484, the first valve third valve conduit 462, and the first container first valve conduit 456. The second stab connector 433 is also connected to the ambient conduit 600 via the junction 602. Hence, the socket is connected with the seawater at ambient pressure outside the fluid exchange unit 420. Thus, the freshwater 570 in the socket is also now at ambient pressure. There is no longer any pressure difference across the "O" ring 434.

[FIG. 9(*e*)] The first actuating valve 510 is reconfigured to connect the pump 500 to the first actuator cylinder 490. The pump forces pressurized liquid into the second port 495 of the first actuator cylinder 490 below the first actuator piston 492 via the pump junction conduit 502, the first actuating valve conduit 506 and the first valve second port conduit 497. This forces the first actuator piston up towards the top of the first actuator cylinder. Liquid in the first actuator cylinder 490 above the first actuator piston 492 is expelled via the first valve first port conduit 496, the first actuating valve 510 and its associated exhaust outlet 512. The movement of the first actuator piston 492 pulls the connected first container piston 491 upwards, forcing the seawater 530 stored in the first fluid container 450 into the socket 430 via the first container first valve conduit 456, the first valve third valve conduit 462 and the second stab connector conduit 484. This forces the freshwater 570 out of the socket 430 and into the first fluid container 450 via the first stab connector conduit 482, the second valve third valve conduit 472 and the first container second valve conduit 458.

[FIG. 9(*f*)] The third hydraulic valve 480 is reconfigured to isolate the socket 430 from the fluid containers 450,650. The first and second hydraulic valves 460,470 are already configured to isolate the second fluid container 650 having closed the second container first valve conduit 458 and the second container second valve conduit 458. The third hydraulic valve 480 closes the second valve third valve conduit 472 isolating the second port 454 of the first fluid container 450. The first container piston 491 is positioned at the top of the first fluid container 450 thus sealing the first port 452 of the first container 450.

[FIG. 9(*g*)] The fluid exchange unit 420 moves away with the retrieved socket 430 from the plug 440 with the surrounding seawater being drawn into the socket.

The flushing action of the freshwater in the third embodiment removes seawater and any residue from the socket.

A fourth embodiment of the invention will now be described with reference to FIGS. 10 to 11(*g*). Where a part in the first embodiment has a reference numeral and there is a substantially corresponding part in the fourth embodiment the same reference numeral has been used except that the number eight hundred has been added to the latter. Not all such parts will be described in detail.

Figure 10:
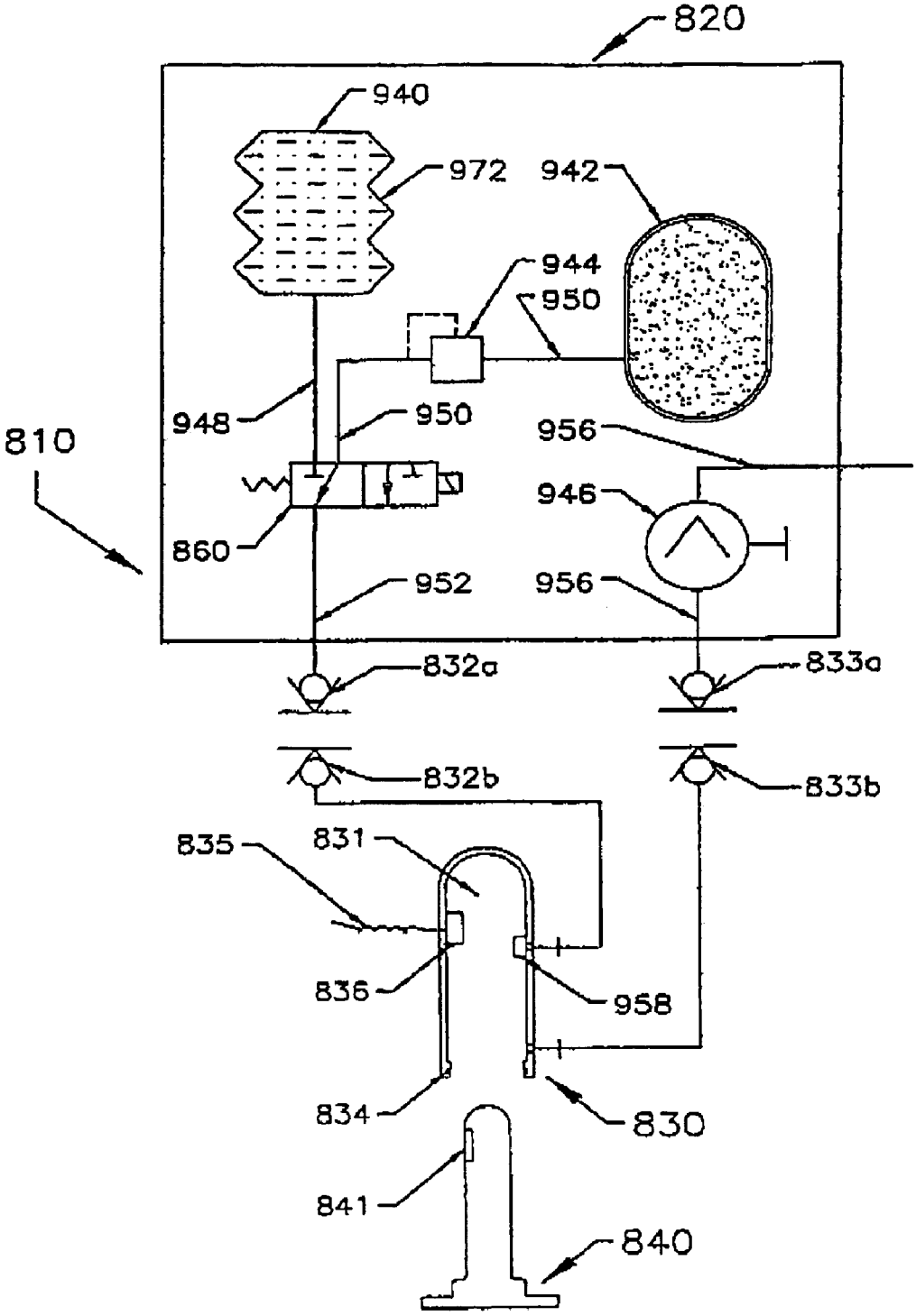
FIG. 10 is a detailed schematic view of an electrical connector and plug of a fourth embodiment of the invention.
Figure 11C:
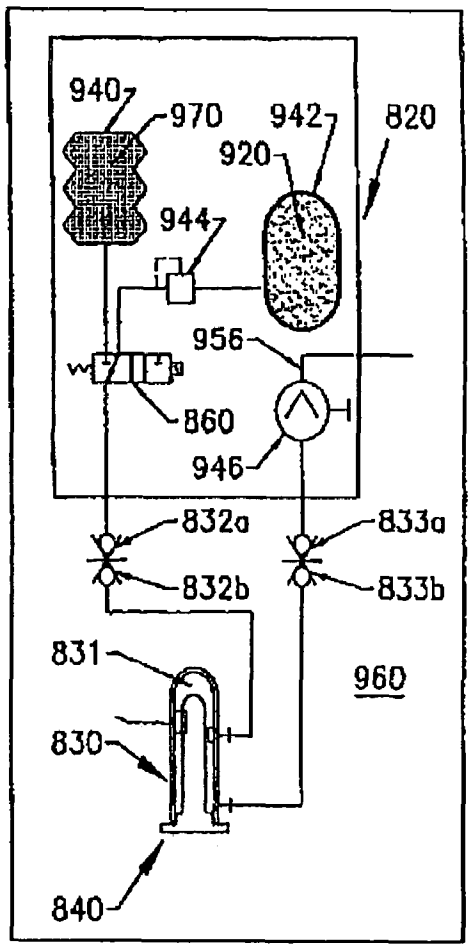
FIGS. 11(*a*) to 11(*g*) are schematic views of the fourth embodiment of the invention showing the installation of the socket of the connector on the plug.
Figure 11B:
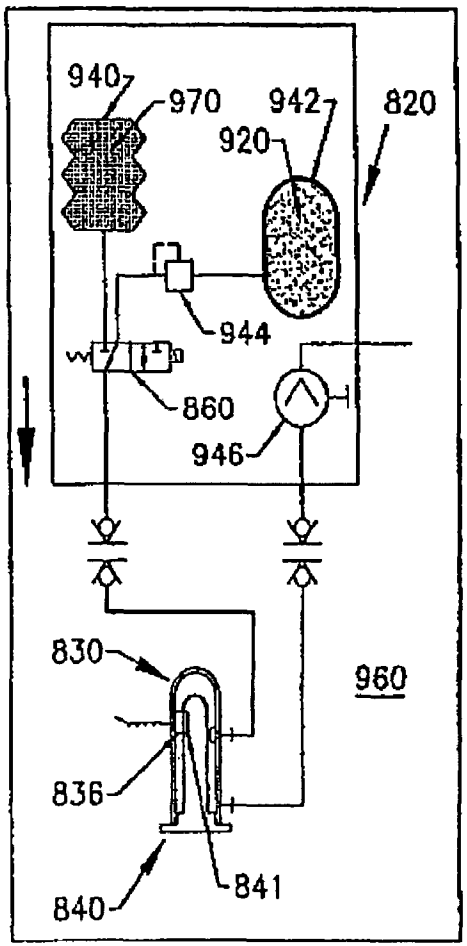
Figure 11A:
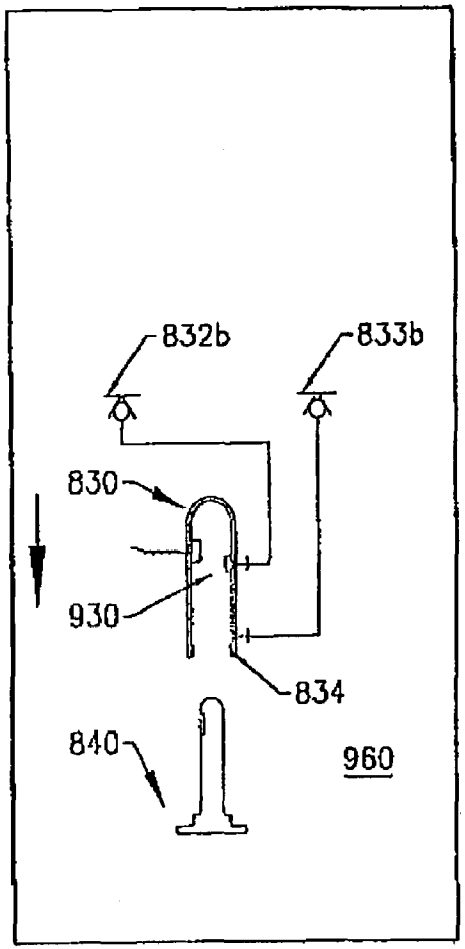
Figure 11E:
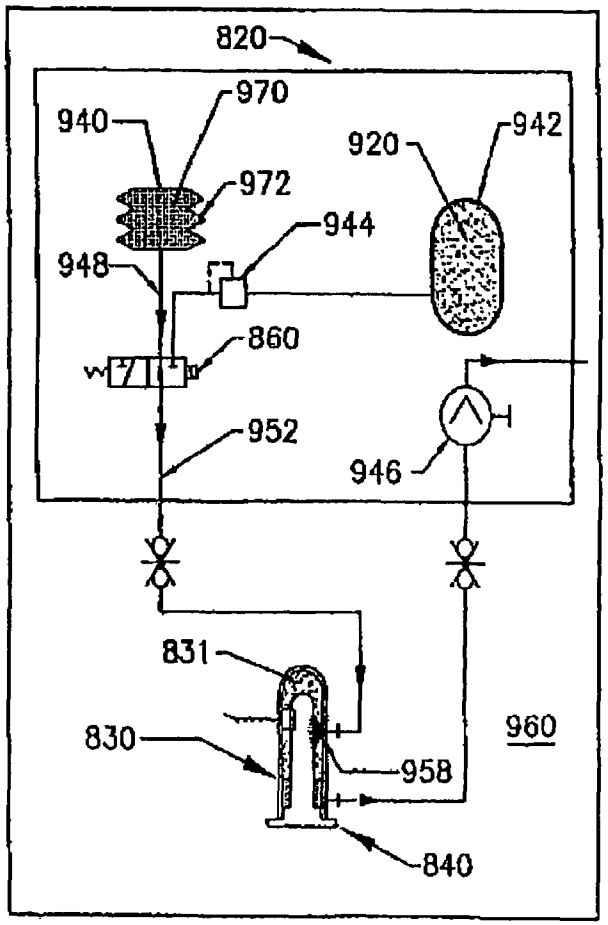
Figure 11D:
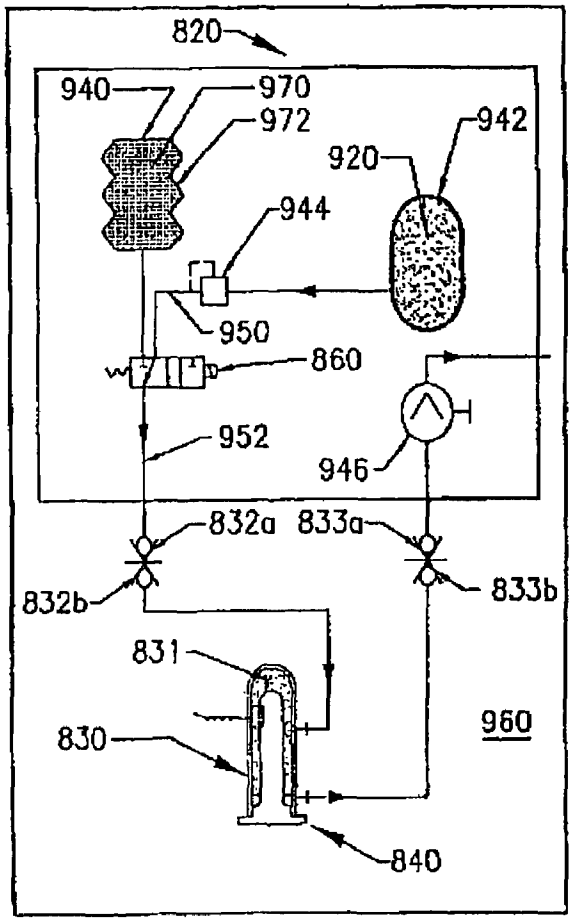
Figure 11G:
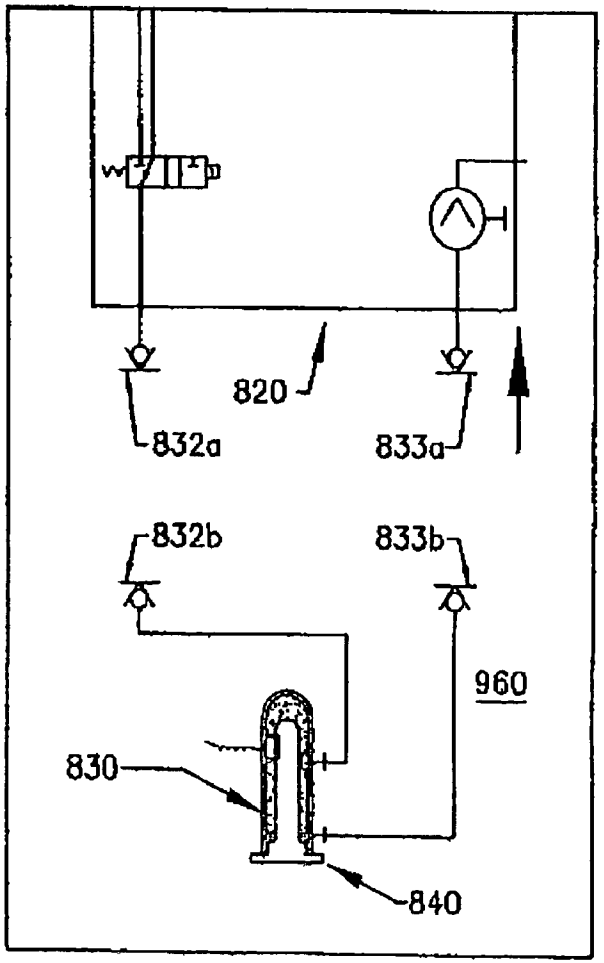
Figure 11F:
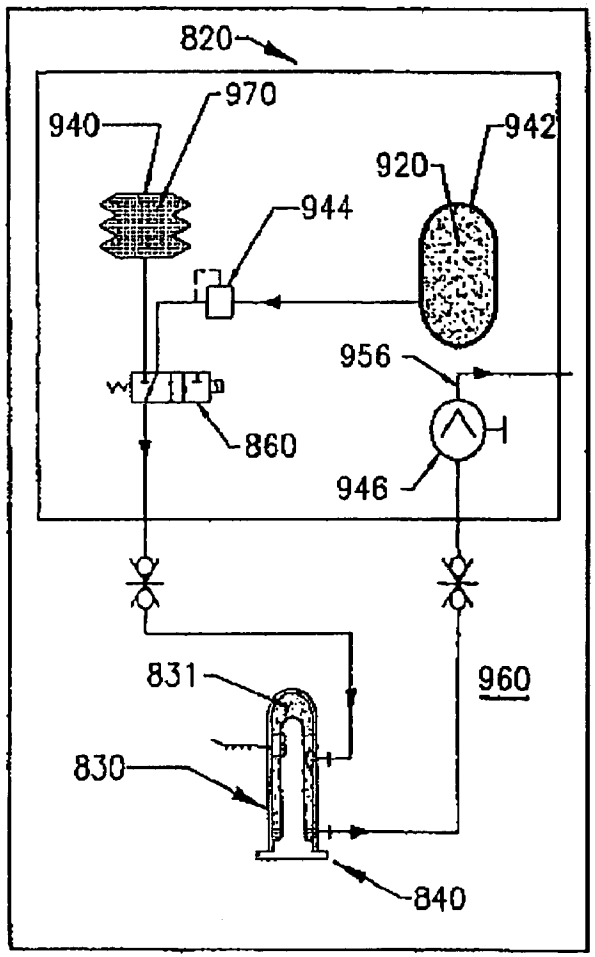

Referring to FIG. 10, an electrical connector 810 according to a fourth embodiment of the invention is shown. The connector comprises an external fluid exchange unit 820 with an associated separate socket 830, the unit and socket being adapted to be connected to each other by first and second stab connectors 832*a*,832*b*;833*a*,833*b*. The fluid exchange unit 820 has first portions 832*a*,833*a* of the first and second stab connectors and the socket 830 has second complementary portions 832*a*,833*a* of the first and second stab connectors. The first and second portions 832*a*,832*b*; 833*a*,833*b* of the stab connectors isolate the inside of the fluid exchange unit 820 and the socket 830 until they engage each other. Below the socket 830 is shown a plug 840. Both the socket and plug are substantially the same as that described in the first embodiment.

Inside the fluid exchange unit 820 is a flushing fluid device 940 comprising a chamber or reservoir, such as a storage bladder, with a thin flexible wall 972, the flushing fluid device being connected to the first portion 832*a* of the first stab connector via a hydraulic valve 860. A pressure vessel 942 is also connected to the connector first portion 832*a* via the hydraulic valve 860, there being a pressure regulator 944 between the pressure vessel and the hydraulic valve. In addition, the fluid exchange unit 820 has a positive displacement pump 946 connected to the first portion 833*a* of the second stab connector.

A device-valve conduit 948 connects the flushing fluid device 940 to the hydraulic valve 860 and a vessel-valve conduit 950 connects the pressure vessel 942 to the hydraulic valve 860 via the pressure regulator 944. A valve-stab connector conduit 952 connects the hydraulic valve 860 to the first portion 832*a* of the first stab connector and the first portion 833*a* of the second stab connector is connected to an outlet 954 to the fluid (e.g. the sea) surrounding the fluid exchange unit 820 by a fluid discharge line 956 in which the positive displacement pump 946 is connected. The pump 946 prevents backflow from the outlet 954 to the first portion 833*a* of the second stab connector.

Referring to FIGS. 11(*a*) to 11(*g*), and additionally to FIG. 10, the process of installing the socket 830 on the plug 840 in seawater 960 will be described.

[FIG. 11(*a*)] The socket 830 forms part of a module (not shown) lowered towards the plug 840 by a vessel at sea level. Inside the socket is seawater 930 that is at ambient pressure. As the plug 840 enters the socket 830 via the "O" ring 834, seawater 930 is compressed inside the socket. However, means, such as a one way valve, may be provided to enable seawater to be displaced from inside the socket into the surrounding sea when the plug is inserted.

[FIG. 11(*b*)] The electrical contacts 841 (only one shown) of the plug become coupled to the electrical contacts 836 of the socket once the plug has been fully inserted into the socket. However, no power is as yet supplied to this connection. The external fluid exchange module 820 is lowered towards the socket 830 by a remotely operated vehicle (ROV). The pressure inside the fluid exchange module is substantially ambient. The flushing fluid device 940 contains glycol, water or other flushing medium 970 and the pressure vessel 942 is full of pressurized gas 920 such as air, nitrogen or sulphur hexafluoride ($SF_6$). Nitrogen or $SF_6$ may also be used in any of the other three embodiments described. The hydraulic valve 860 is initially configured to connect the pressure vessel 942 to the first portion 832*a* of the first stab connector.

[FIG. 11(*c*)] When the first portions 832*a*,833*a* of the first and second stab connectors engage the complementary second portions 832*b*,833*b*, the pressure vessel is connected to the chamber 831 of the socket and the fluid discharge line 956 is connected to the chamber 831. The seawater 930 in the socket 830 is thus connected to the pressure regulator 944 where gas 920 from the pressure vessel 942 is regulated to a pressure of $10^5$ Pa (1 bar), hence the seawater is now at a pressure of $10^5$ Pa (1 bar). If nitrogen or $SF_6$ is used, the pressure regulator 944 would regulate gas from the pressure vessel to about $2\times10^5$ Pa to $3\times10^5$ Pa (2 to 3 bar). The seawater in the socket is accordingly sealed from the surrounding seawater at ambient pressure as there is a pressure difference across the "0" ring 834.

[FIG. 11(*d*)] The positive displacement pump 946 is actuated to remove the seawater 930 from the chamber 831 of the socket 830 into the seawater surrounding the fluid exchange unit 820 via the second stab connector 833*a,b* and the fluid discharge line 956 enabling gas 920 from the pressure vessel 942 to enter the chamber 831 via the vessel-valve conduit 950, the hydraulic valve 860, the valve-stab connector conduit 952 and the first stab connector 833*a,b*, the gas being at the pressure set by the pressure regulator 944.

[FIG. 11(*e*)] The hydraulic valve 860 is reconfigured in a conventional manner to connect the flushing fluid device 940 to the socket 830, enabling flushing fluid 970 to flow from the device into the chamber 831 via the valve-stab connector conduit 952. The ambient pressure inside the fluid exchange device 820 acts on the flexible wall 972 of the flushing fluid device forcing the flushing fluid to be sprayed onto the plug 840 via a nozzle 958 or other suitable spraying means cleaning the plug insulation. This removes salt and/or dirt/contaminants from the surface of the plug which could otherwise build up to form an electrical path that could short circuit the electrical connection of the engaged plug 840 and socket 830. The sprayed flushing fluid 970 collects at the bottom of the chamber 831.

[FIG. 11(*f*)] The first hydraulic valve 860 is reconfigured to its initial position and the positive displacement pump 946 is activated to remove the sprayed flushing fluid from the chamber 831 and into the seawater surrounding the fluid exchange unit 820 via the fluid discharge line 956 enabling further gas 920 from the pressure vessel 942 to enter the chamber. However, a small amount of flushing fluid 970 may remain in the chamber 831 once the pumping has been finished. Thus, the chamber 831 is now substantially filled with gas 920 at the pressure set by the pressure regulator 944.

If insufficient dirt/salt is removed from the plug 840 then the process as described above for FIGS. 11(*e*) and 11(*f*) can be repeated until the required electrical isolation is achieved.

[FIG. 11(*g*)] The fluid exchange unit is lifted away from the socket 830 causing the first and second portions 832*a*, 833*a*;832*b*,833*b* of the stab connectors to disengage, sealing the insides of the socket 830 and the exchange unit 820 against the ingress of seawater. Power can now be applied to the electrical coupling between the plug 840 and socket 830 in a known manner, the air in the socket being at a pressure of $10^5$ Pa (1 bar). If nitrogen or $SF_6$ is used, the gas in the socket would be about $2\times10$ Pa to $3\times10^5$ Pa (2 to 3 bar).

To remove the socket 840, the module containing the socket can be simply retrieved by a vessel at sea level and the socket can be used on other plugs. When the socket is used on another plug, the external fluid exchange unit 820 can be lowered to remove salt/dirt from the plug 830 in the way as just described above. The fluid exchange unit 820 is accordingly not left connected to the socket 830 and can be used to install other sockets and can be retrieved for maintenance and/or replenishment of the flushing device and pressure vessel.

In the described embodiments the fluid exchange unit can be manoeuvred underwater in a variety of ways such as by ROVs, by divers, or by a holding frame or crane. The fluid exchange unit may be a remotely operated tool (ROT). The pump and valves can be activated remotely or automatically in a conventional manner.

The pressures given in the above embodiments are approximations.

An advantage of the connector described over known connectors is that the connector makes use of standard pieces of equipment such as hydraulic valves, pumps, containers and compensators, thus easing manufacture and reducing costs.

Furthermore a single fluid exchange unit can be used to install or retrieve many sockets since it does not have to be left on the sea-bed connected to a socket that it has installed. A further advantage of the separable nature of the fluid exchange unit and socket is that the fluid exchange unit can easily be recovered to the sea surface thus permitting any maintenance to be easily effected.

Whilst particular embodiments have been described above it will be understood that various modifications may be made without departing from the scope of the invention. For example, the air used may be replaced by a fluid such as an inert gas, and the pressure of fluid that is not at ambient pressure does not necessarily have to be at $10^5$ Pa (1 bar). The or each hydraulic actuator, which is connected to a fluid container, may alternatively be replaced by a mechanical and/or an electrical actuator. The mechanical actuator may include a driven screw thread which moves the container piston within the fluid container. Suitable alternative hydraulic actuators may also be used. As an alternative to using a liquid as an actuating medium for operating the device described above, a fluid, such as air or another gas or gaseous mixture, could be used.

In the fourth embodiment, the fluid discharge line may be replaced with a shuttle valve and empty bladder to retain the flushing liquid if liquid considered harmful to the environment is used. The pressure of the gas 970 from the pressure vessel 942 may, at least, partially force fluid from the socket 830. The flushing fluid device may comprise a reverse osmosis system and storage chamber for producing flushing fluid from seawater.

What is claimed is:

1. A method of installing a socket with a socket contact on an underwater plug with a plug contact so as to establish conductive contact between the socket contact and the plug contact, comprising steps of:

(a) providing a recoverable fluid exchange unit including at least one positive displacement pump;

(b) engaging the socket with the plug and establishing the conductive contact between the socket contact and plug contact; and (c) operating the recoverable fluid exchange unit to substantially replace a first fluid within the socket with a second fluid from the recoverable fluid exchange unit by means of the at least one positive displacement pump.

2. The method as claimed in claim 1, wherein the step of substantially replacing the first fluid within the socket includes discharging the first fluid exteriorly of the recoverable fluid exchange unit and the socket.

3. The method as claimed in claim 1, including the step of supplying a flushing fluid to the plug after the first fluid win the socket has been substantially removed therefrom.

4. The method as claimed in claim 3, including the step of substantially replacing the removed first fluid with the second fluid before supplying the flushing fluid to the plug.

5. The method as claimed in claim 3, including the step of substantially removing the flushing fluid from the socket and subsequently filling the socket with the second fluid.

6. The method as claimed in claim 1, wherein the step of substantially replacing the first fluid within the socket includes transferring the first fluid from the socket to a fluid storage region of the recoverable fluid exchange unit.

7. The method as claimed in claim 1, wherein the step of engaging the socket with the plug includes venting the socket exteriorly of the recoverable fluid exchange unit to permit part of the first fluid in the socket displaced by entry of the plug thereinto to be discharged exteriorly of the recoverable fluid exchange unit.

8. The method as claimed in claim 1, wherein the step of replacing the socket with the plug includes flowing a part of the first fluid in the socket displaced by entry of the plug thereinto into a compensator of the recoverable fluid exchange unit.

9. The method as claimed in claim 1, wherein the step of replacing the first fluid in the socket with the second fluid from the recoverable fluid exchange unit includes the steps of exchange the first fluid in the socket with a flushing fluid from the recoverable fluid exchange unit; and subsequently exchanging the flushing fluid in the socket with the second fluid from the recoverable fluid exchange unit.

10. The method as claimed in claim 1, wherein the flow of fluids between the socket and the recoverable fluid exchange unit are controlled by valve means of the recoverable fluid exchange unit.

11. The method as claimed in claim 1, including simultaneous exchange of fluids between the socket and a fluid storage region of the recoverable fluid exchange unit wherein the at least one positive displacement pump is used to force one fluid into the socket and simultaneously draw a second fluid therefrom.

12. The method as claimed in claim 1, wherein the at least one positive displacement pump comprises a piston and cylinder device activated by an actuator.

13. The method as claimed in claim 1, wherein the step of substantially replacing the first fluid within the socket with the second fluid from the recoverable fluid exchange unit causes the socket to be pressure scaled from the environment surrounding the socket.

14. The method as claimed in claim 1, including the step of reusing the recoverable fluid exchange unit to replace a fist fluid in another socket with a second fluid from the recoverable fluid exchange unit.

15. The method as claimed in claim 3, wherein the flushing fluid is forced from a chamber of the recoverable fluid exchange unit into the socket by the pressure inside the recoverable fluid exchange unit.

16. The method as claimed in claim 15, wherein the flushing fluid is forced from the flushing fluid chamber by the pressure inside the recoverable fluid exchange unit acting on at least a flexible portion of a wall of the flushing fluid chamber.

17. The method as claimed in claim 1, further comprising the steps of accommodating the second fluid in a pressure vessel in the recoverable fluid exchange unit, and delivering the second fluid to the socket as a consequence of the first fluid being drawn out of the socket.

18. The method as claimed in claim 1, further comprising the step of disconnecting the recoverable fluid exchange unit from the socket and recovering it.

19. The method as claimed in claim 18, wherein the step of disconnecting the recoverable fluid exchange unit from the socket includes disconnecting one or more stab connectors between the recoverable fluid exchange unit and the socket each of which has male and female parts which are disengageable by pulling the recoverable fluid exchange unit away from the socket.

* * * * *